US007459002B2

(12) United States Patent
Kalous et al.

(10) Patent No.: US 7,459,002 B2
(45) Date of Patent: Dec. 2, 2008

(54) MODULAR PRESENTATION APPARATUS HAVING INTEGRAL AIR PROCESSING APPARATUS

(75) Inventors: D. Scott Kalous, Gurnee, IL (US); Charles Harris, Gurnee, IL (US)

(73) Assignee: Airistar Technologies LLC, Waukegan, IL (US)

( * ) Notice: Subject to any disclaimer, the term of this patent is extended or adjusted under 35 U.S.C. 154(b) by 220 days.

(21) Appl. No.: 10/931,190

(22) Filed: Aug. 31, 2004

(65) Prior Publication Data

US 2006/0042205 A1 Mar. 2, 2006

(51) Int. Cl.
*B01D 46/00* (2006.01)

(52) U.S. Cl. ..... 55/385.1; 55/385.2; 55/473; 55/356; 55/DIG. 18; 273/287; 273/309; 454/230; 454/306; 454/338

(58) Field of Classification Search ..... 55/385.1, 55/385.2, 473, 356, DIG. 18; 273/287, 309; 454/230, 306, 338
See application file for complete search history.

(56) References Cited

U.S. PATENT DOCUMENTS

| | | | | | |
|---|---|---|---|---|---|
| 3,284,148 | A | * | 11/1966 | Ramniceanu | 312/209 |
| 3,747,300 | A | | 7/1973 | Knudson | 55/126 |
| 4,210,429 | A | | 7/1980 | Golstein | 55/279 |
| 4,244,712 | A | | 1/1981 | Tongret | 55/124 |
| 5,160,517 | A | * | 11/1992 | Hicks et al. | 55/385.1 |
| 5,192,342 | A | | 3/1993 | Baron et al. | 55/97 |
| 5,240,478 | A | | 8/1993 | Messina | 95/273 |
| 5,322,473 | A | | 6/1994 | Hofstra et al. | 454/186 |
| 5,360,469 | A | | 11/1994 | Baron et al. | 95/273 |
| 5,417,433 | A | * | 5/1995 | Phillips | 273/309 |
| 5,441,279 | A | * | 8/1995 | Messina | 273/309 |
| 5,616,172 | A | | 4/1997 | Tuckerman et al. | 96/16 |
| 5,997,619 | A | | 12/1999 | Knuth et al. | 96/224 |
| 6,099,607 | A | | 8/2000 | Haslebacher | 55/356 |
| 6,464,760 | B1 | * | 10/2002 | Sham et al. | 96/117.5 |
| 7,112,232 | B2 | * | 9/2006 | Chang et al. | 55/481 |
| 2003/0024218 | A1 | * | 2/2003 | Stephens et al. | 55/413 |
| 2003/0033790 | A1 | * | 2/2003 | Hague | 55/385.1 |
| 2004/0103789 | A1 | * | 6/2004 | Lan et al. | 96/146 |
| 2005/0097870 | A1 | * | 5/2005 | Moshenrose | 55/385.1 |

* cited by examiner

*Primary Examiner*—Duane Smith
*Assistant Examiner*—Minh-Chau T. Pham
(74) *Attorney, Agent, or Firm*—Patzik, Frank & Samotny Ltd.

(57) ABSTRACT

An example presentation apparatus having a cabinet-like base and a surface coupled to the cabinet-like base and configured to hold an object. The cabinet-like base and the surface are configured to cooperate functionally with a function of the object. A portion of an air processing apparatus is disposed within the cabinet-like base and configured to move ambient air through the cabinet-like base to generate processed air. An exhaust structure is operatively coupled to the cabinet-like base and configured to enable the processed air to exit the presentation apparatus via a flow path that is spatially associated with a substantially predetermined position of the object.

41 Claims, 11 Drawing Sheets

MODULAR PRESENTATION APPARATUS HAVING INTEGRAL AIR PROCESSING APPARATUS

FIELD OF THE DISCLOSURE

The present disclosure relates generally to presentation apparatus and, more particularly, to presentation apparatus having integral air processing apparatus.

BACKGROUND

Concern over air quality has triggered much interest and many developments in the area of indoor air quality improvement and/or control. Such developments have resulted in the production of various types of air processing devices including air filtration apparatus. Air filtration apparatus are often differentiated according to air filtering capabilities and generally include air filtration devices designed to be integrated within a heating, ventilation, and air conditioning (HVAC) system and local or unitary air filtration devices. Air filtration devices configured to be integrated with HVAC systems (i.e., integrated air filtration devices) are typically capable of filtering large amounts of ambient air such as, for example, an amount of ambient air that fills a warehouse, an office building, an apartment building, a house, an entertainment hall, etc. In contrast, local or unitary air filtration devices are typically configured to filter an amount of ambient air associated with a local area such as, for example, an office, a bedroom, a bathroom, etc.

Integrated air filtration devices are typically large, bulky, and aesthetically unpleasing devices that are usually installed, for example, in a ceiling plenum, in a mechanical room, on a building roof top or otherwise outside of a building or structure, etc. By installing such integrated area air filtration devices in plenum spaces, on the outside of buildings, etc., integrated air filtration devices do not occupy valuable space (e.g., living space, work space, etc.) within the buildings and remain hidden from the view of building occupants.

In contrast, local or unitary air filtration devices are typically physically smaller than integrated air filtration devices and, thus, may be readily movable or portable from one space to another. Local or unitary air filtration devices are typically employed by individuals to improve the air quality within an immediate or local area such as, for example, an office, a family room, a bathroom, etc. The smaller size of these local or unitary air filtration devices enables one or more of these devices to be placed in various locations throughout a space or area (e.g., a room) within which ambient air is to be filtered. In addition, the local or unitary air filtration devices are typically designed to be placed in locations that are within the view of occupants of the locations. For example, the physical structures (e.g., enclosure or housing components) of these air filtration devices may be designed to be aesthetically pleasing and/or to be as unobtrusive as possible in view of other objects (e.g., firnishings, decor, etc.),that are typically present in the occupied spaces or areas.

Each type of air filtration device is typically configured to target specific filtering needs or requirements. For example, HVAC system integrated air filtration devices are configured to filter large amounts of ambient air over extended periods of time. In many cases, a considerable amount of time is required to filter all of the air within an entire building or structure. This is often acceptable for structures requiring minimal air filtration or that experience a relatively low rate of air quality degradation. In buildings or structures within which the rate of air quality degradation is relatively low, an HVAC system integrated air filtration device may operate only occasionally to maintain an acceptable air quality rating. However, in other buildings or structures such as, for example, bars, casinos, night clubs, etc., within which the rate of air quality degradation is relatively high, the integrated air filtration device may work continuously to maintain an acceptable air quality. In some cases, structures having higher rates of air quality degradation require larger HVAC system integrated air filtration devices. Many buildings or structures have multiple areas or spaces, each of which has a different air quality degradation rate and/or characteristic. Such areas or spaces may include high traffic (e.g., high occupancy density) areas smoking areas, non-smoking areas, etc. However, HVAC system integrated air filtration devices are typically configured to filter all or many areas within a structure at the same time and in the same manner (e.g., evenly). As a result, such HVAC system integrated air filtration devices are unable to filter the air in some areas more than other areas.

An alternative or additional approach to addressing the needs of spaces having larger rates of air quality degradation and/or a plurality of areas having different air quality degradation rates involves the use of a plurality of local or unitary air filtration devices distributed throughout the spaces and/or areas. In this manner, the plurality of air filtration devices may operate to filter the air in a relatively large area or an entire building by cooperating to filter the ambient air in multiple local areas. For example, an air filtration device in one area or space may be operated at a different air filtration rate than an air filtration device located in another area or space.

Installing or locating a local or unitary air filtration device in a space or area consumes a certain amount of space (e.g., floor space). When installing a single local air filtration device within an office or a household room, the amount of space occupied by that air filtration device may be insignificant. However, when installing a plurality of air filtration devices throughout a building or a structure to filter large amounts of air as described above, the total space occupied by those air filtration devices may be a significant amount of space that could otherwise be used as functional space within the building or structure.

One solution to reduce the amount of space required by a plurality of local air filtration devices located within a space or spaces involves reducing the required number of air filtration devices by, for example, increasing the air filtering capacity of each local air filtration device. In this manner, fewer air filtration devices are needed to achieve a desired air quality. However, this approach may lead to larger, noisier, and more obtrusive air filtration devices that are not appealing to purchasers of the air filtration devices or to patrons of a business (e.g., a mall, a casino, a bar, etc.) operating in the area(s) within which the larger local air filtration devices are located.

DETAILED DESCRIPTION

Figure 1:
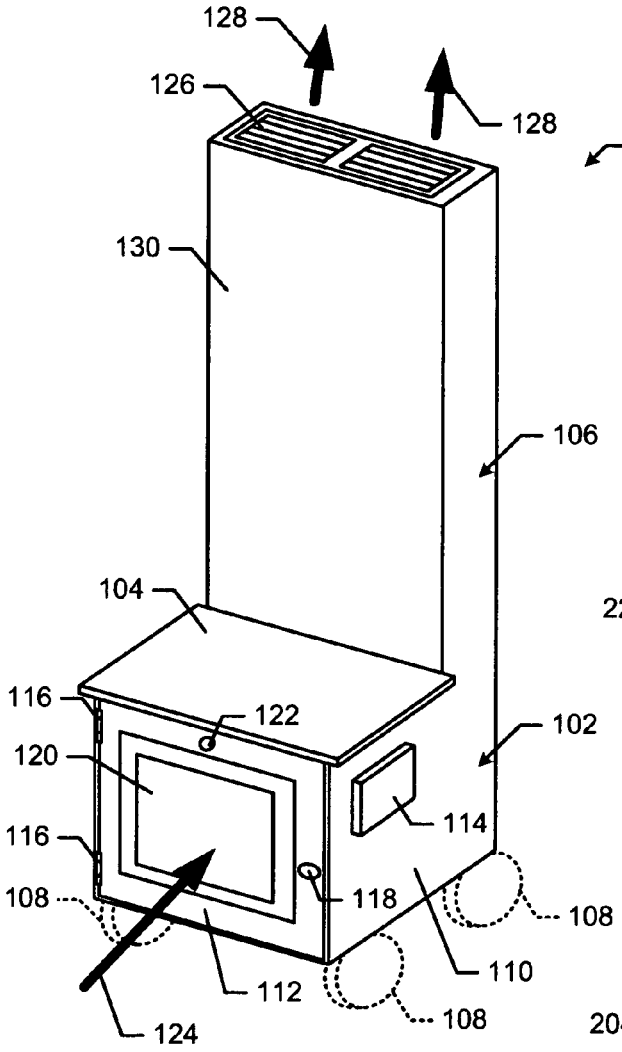
FIGS. 1 and 2 illustrate example presentation apparatus having integral air processing apparatus.
Figure 2:
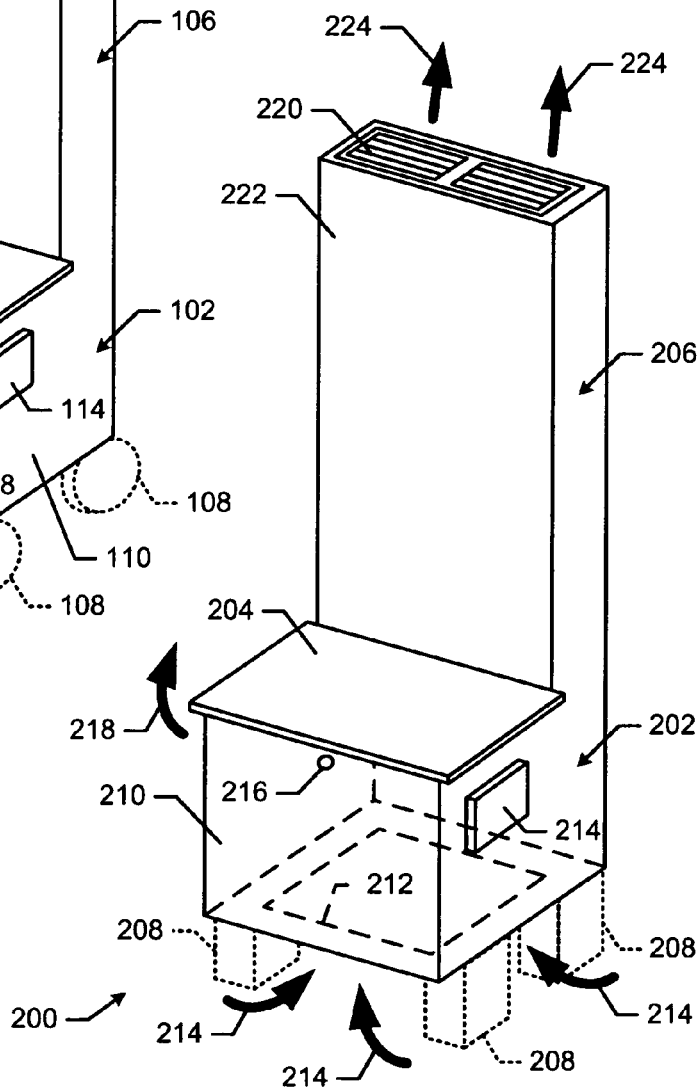

FIGS. 1 and 2 illustrate example presentation apparatus 100 and 200, each having an integral air processing apparatus (e.g., one of the air filtration apparatus 702 described below in connection with FIG. 7B, the air filtration apparatus 802 described below in connection with FIG. 8B, and the air filtration apparatus 852 described below in connection with FIG. 8C). In general, the example presentation apparatus 100 and 200 may be used to hold objects and is configured to cooperate functionally with respective functions of the objects as described in greater detail below in connection with FIGS. 3 through 6. In addition, the example presentation apparatus 100 and 200 may also be used as local or unitary air processing devices such as, for example, local or unitary air filtration devices, and may be located throughout a space or area of a building or structure. In this manner, one or more of the example presentation apparatus 100 and 200 may work cooperatively to process or filter ambient air in respective local areas or spaces. Example presentation apparatus that are substantially similar or identical to the example presentation apparatus 100 and 200 may be used to perform multiple functions including holding and/or presenting an object and processing (e.g., filtering) ambient air to generate processed (e.g., filtered) air, thereby using space within a building or structure in a relatively efficient manner and saving space throughout areas within which the example presentation apparatus are located.

The example presentation apparatus 100 includes a cabinet 102, a surface 104 (e.g., a mounting surface) coupled to the cabinet 102, and an exhaust structure 106 operatively coupled to the cabinet 102 and configured to guide processed air out of the cabinet 102. In addition, a plurality of casters 108 (i.e., wheels, rotatable mechanisms, etc.) may be mechanically coupled to the cabinet 102 and configured to facilitate the movement of the example presentation apparatus 100 from a first location to a second location. Alternatively, a plurality of legs (e.g., the legs 208 of FIG. 2) may be mechanically coupled to the cabinet 102 and configured to hold the example presentation apparatus 100 above a floor. Of course, the wheels 108 and legs 208 are optional structures.

The cabinet 102 may include a cabinet-like base 110 (i.e., a base 110) as shown in FIG. 1 or any other type of base or base portion configured to hold at least a portion of an air processing apparatus (e.g., the air filtration apparatus 702 of FIG. 7). The cabinet 102 may further include an access panel 112 coupled to the base 110 and a control panel 114 mechanically coupled to the base 110. Although, the cabinet 102 is shown as having a relatively cubical structure, any other geometry or structure may be used to implement the cabinet 102 including, for example, a pyramidal structure, a cylindrical structure, a trapezoidal structure, etc.

The access panel 112 may be configured to enable access to an air processing apparatus within the cabinet 102. For example, the access panel 112 may be coupled to the base 110 via hinges 116 and may include a secure entry handle 118. A person may unlock the secure entry handle 118 using, for example, a key or any other secure entry device (e.g., a keycard, a number pad, etc.). In this manner, the air processing apparatus within the cabinet 102 may be accessed for maintenance, inspection, and/or any other desired purpose.

The access panel 112 may also include an intake vent 120 (i.e., an intake structure) and a sensor aperture 122. The intake vent 120 may be configured to operate in combination with an air processing apparatus by enabling ambient air to flow into the cabinet 102 in a direction generally indicated by arrow 124. In addition, if the example presentation apparatus 100 is placed in a high traffic area and/or an area in which it may be subject to physical abuse, the intake vent 120 may also be configured to protect the portion of the air processing apparatus located within the cabinet 102. The intake vent 120 may include a grate (not shown), a screen (not shown), and/or a large particle filter (not shown). In one implementation, a layered configuration for the intake vent 120 may include the grate as the outermost layer followed by the screen, and the large particle filter as the innermost layer. The grate may be impact resistant to prevent damage to the screen, the large particle filter, and the portion of the air processing apparatus located within the cabinet 102. The screen may be configured to prevent relatively large objects (e.g., paper, coins, food, etc.) from entering into the cabinet 102. The large particle filter may be configured to prevent relatively large particles (e.g., dust, hair, lint, liquid, etc.) from entering the cabinet 102.

The sensor aperture 122 may be configured to hold a sensor (e.g., the first sensors 714*a*, 814*a*, and 864*a* described below in connection with FIGS. 7B, 8B, and 8C, respectively), which may be used to obtain measurements associated with air processing operations. In one example, the sensor aperture 122 may be configured to hold a smoke or particle sensor, which may be used to detect an amount of smoke in the ambient air surrounding the example presentation apparatus 100. In another example, the sensor aperture 122 may be used to hold a proximity sensor, which may be used to detect if a person is within proximity of the example presentation apparatus 100. As described in greater detail below, measurements made by a sensor held within the sensor aperture 122 may be used to control the operation of an air processing apparatus located within the cabinet 102. Although, one sensor aperture (e.g., the sensor aperture 122) is shown, any number of sensor apertures may be formed in the access panel 112 and/or at any other location on the example presentation apparatus 100.

The control panel 114 may be mechanically coupled to the cabinet 102 and configured to provide input and output data capabilities for controlling and/or monitoring any aspect of the example presentation apparatus 100 and/or an air processing apparatus located therein. For example, the control panel 114 may be used by a person to control operational states of the air processing apparatus. In addition, the control panel 114 may be used to access status information associated with operations and/or status of the air processing apparatus. The control panel 114 is described in greater detail below in connection with FIGS. 9, 10, 11A, and 11B. Although, the control panel 114 is shown as being mechanically coupled to an outside surface of the cabinet 102, the control panel 114 may instead be mechanically coupled to an inside surface of the cabinet 102. Alternatively, the control panel 114 may be mechanically coupled at any other location or any surface of the example presentation apparatus 100.

Figure 3:
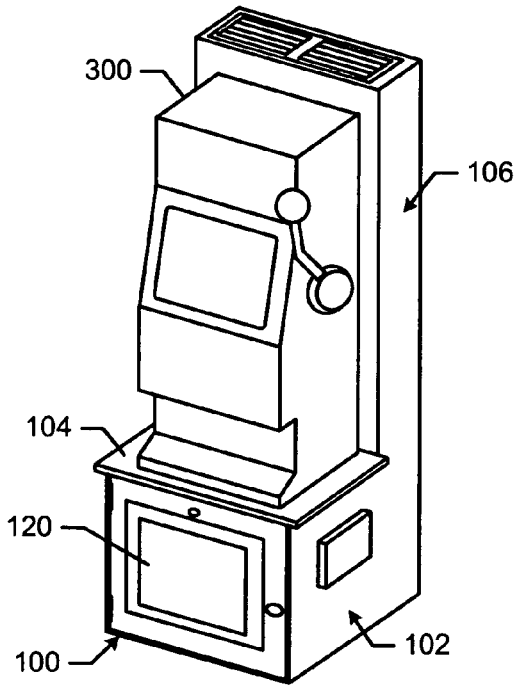
FIG. 3 illustrates the example presentation apparatus of FIG. 1 holding a gaming machine.
Figure 4:
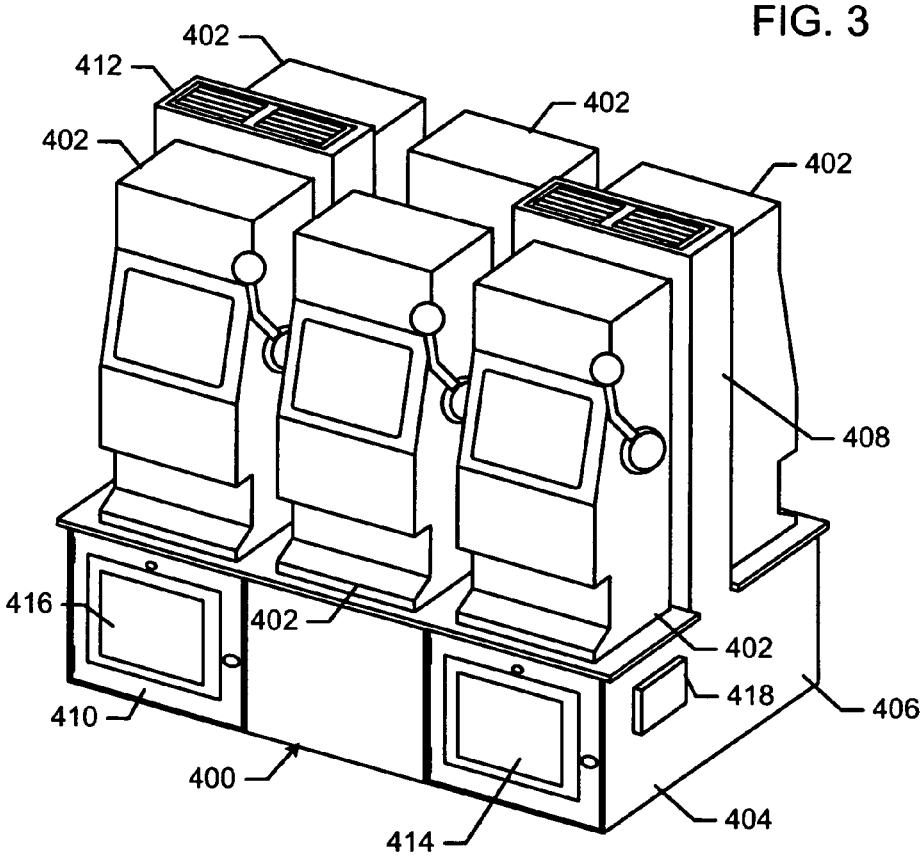
FIG. 4 illustrates an example multi-presentation apparatus holding a plurality of gaming machines.

The surface 104 is mechanically coupled to the cabinet 102 and configured to hold an object such as, for example, a removable object, as illustrated in greater detail in FIGS. 3 and 4. As shown in FIG. 1, the surface 104 may be mechanically coupled to the cabinet 102 in a position that is substantially perpendicular to the exhaust structure 106. However, in some implementations, the surface 104 may be positioned in any other position including any position that enables the surface 104 to hold an object.

The exhaust structure 106 is operatively coupled to the cabinet 102 and configured to guide processed air via a flow path that is spatially associated with a substantially predetermined position of the object. More specifically, the exhaust structure 106 may include an exhaust plenum (e.g., the plenum 704 described below in connection with FIG. 7B) and an exhaust vent 126. The exhaust plenum may be configured to complement a substantially predetermined position of an object held by the surface 104. Specifically, processed air may flow through the plenum about, adjacent to, and/or otherwise in a non-obtrusive manner relative to a space occupied by the object. In this manner, the processed air is capable of flowing in a manner that does not hinder and/or that facilitates the functionality of an object held by the surface 104. The processed air may then exit the example presentation apparatus 100 via the exhaust vent 126 along a flow path or paths directed substantially away from an object held by the surface 104 as generally indicated by the arrows 128.

Figure 5:
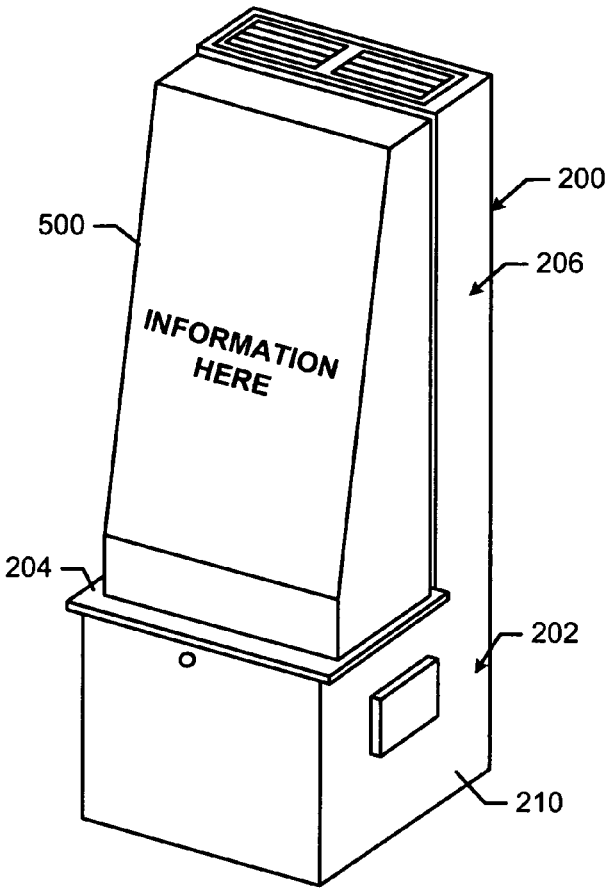
FIGS. 5 and 6 illustrate the example presentation apparatus of FIG. 2 holding information displays.

The exhaust structure 106 includes an outer plenum surface 130, which may be parallel to a plane that is substantially perpendicular and/or intersects the surface 104. The outer plenum surface 130 may be a mounting surface that is used to hold or support an object as described below in connection with FIG. 6. In addition, the outer plenum surface 130 may be used to cover, protect, and/or provide at least partial support to an object held by the surface 104 as illustrated in FIGS. 3 through 5.

The example presentation apparatus 200 may be similar or identical in some aspects to the example presentation apparatus 100 and includes a cabinet 202, a surface 204 (e.g., a mounting surface) coupled to the cabinet 202, and an exhaust structure 206 operatively coupled to the cabinet 202 and configured to guide processed air out of the cabinet 202. In addition, a plurality of legs 208 may be mechanically coupled to the cabinet 202 and configured to hold the example presentation apparatus 200 above a floor surface. Of course the legs 208 are optional and may be replaced by one or more rotatable devices such as wheels, casters, etc.

The cabinet 202 includes a cabinet-like base 210 (i.e., the base 210) configured to hold at least a portion of an air processing apparatus. The base 210 may include an intake vent 212 (i.e., an intake structure) located at the bottom surface of the base 210. The intake vent 212 may be configured to operate in combination with an air processing apparatus by enabling ambient air to flow into the cabinet 202 in a direction generally indicated by arrows 214. The legs 208 or casters (e.g., the casters 108 of FIG. 1) may be used to elevate the bottom surface of the base 210 so that ambient air may flow into the cabinet 202 via the intake vent 212. The intake vent 212 may be configured to function as a preliminary filter and may include a screen (not shown) and/or a large particle filter (not shown). In one implementation, a layer structure for the intake vent 212 may include the screen as the outermost layer followed by the large particle filter as the innermost layer. The screen may be configured to prevent relatively large objects (e.g., paper, coins, food, etc.) from entering into the cabinet 202. The large particle filter may be configured to prevent relatively large particles (e.g., dust, hair, lint, liquid, etc.) from entering into the cabinet 202.

A control panel 214 may be mechanically coupled to a surface of the cabinet 202 and may be substantially similar or identical to the control panel 114 described above in connection with FIG. 1. Although, the control panel 214 is shown as being mechanically coupled to an outside surface of the cabinet 202, the control panel 214 may instead be mechanically coupled to an inside surface of the cabinet 202. Alternatively, the control panel 214 may be mechanically coupled at any location and on any surface of the example presentation apparatus 200.

The cabinet 202 further includes a sensor aperture 216 that may be substantially similar or identical to the sensor aperture 122 described above in connection with FIG. 1. The example sensor aperture 216 is shown on a front vertical surface of the cabinet 202. However, the sensor aperture 216 may be located at any other location on the example presentation apparatus 200. Although, one sensor aperture (e.g., the sensor aperture 216) is shown, any number of sensor apertures may be formed on the cabinet 202 and/or at any other location on the example presentation apparatus 200.

The surface 204 is mechanically coupled to the cabinet 202 and may be substantially similar or identical to the surface 104 described above in connection with FIG. 1. In addition, the surface 204 may be configured to enable access to the portion of an air processing apparatus located within the cabinet 202. For example, the surface 204 may be coupled to the cabinet 202 via hinges (not shown) to enable the surface 204 to be rotated in a direction generally indicated by the arrow 218. In this manner, the air processing apparatus may be inspected, maintained, etc. by a person.

The exhaust structure 206 is operatively coupled to the cabinet 202 and may be substantially similar or identical to the exhaust structure 106 described above in connection with FIG. 1. The exhaust structure 206 may include an exhaust plenum (e.g., the plenums 804 and 854 described below in connection with FIGS. 8B and 8C, respectively), an exhaust vent 220, and an outer plenum surface 222. The exhaust plenum may be configured to complement a substantially predetermined position of an object held by the surface 204 and/or the outer plenum surface 222. The exhaust vent 220 may be substantially similar to the exhaust vent 126 described above in connection with FIG. 1 and may enable processed air to flow in a direction that is substantially away from an object held by the surface 104 as generally indicated by arrows 224. The outer plenum surface 222 may be substantially perpendicular to and/or intersect a plane that is parallel to the surface 204. The outer plenum surface 222 may be substantially similar or identical to the outer plenum surface 130 (FIG. 1) and may be configured to hold or support an object as described below in connection with FIG. 6.

FIG. 3 illustrates the example presentation apparatus 100 of FIG. 1 holding a gaming machine 300. In particular, the gaming machine 300 is held by the surface 104 (FIG. 1) in a manner that facilitates a function of the gaming machine 300. For example, the gaming machine 300 may be a slot machine as shown in FIG. 3 that is located within a casino, bar, and/or other any other environment. The example presentation apparatus 100 may be configured so that the surface 104, the base 102, and an air processing apparatus held within the cabinet 102 cooperate functionally with the function of the gaming machine 300.

More specifically, the example presentation apparatus 100 is configured to hold the gaming machine 300 via the surface 104 at a predetermined position so that the functionality of the gaming machine 300 is facilitated. For example, the gaming machine 300 may be placed on the surface 104 at a predetermined position relative to the cabinet 102 (FIG. 1) and the exhaust structure 106 (FIG. 1). The intake vent 120 (FIG. 1) and the exhaust structure 106 are spatially configured so that a flow path of air through the example presentation apparatus 100 is not disrupted or obstructed by the gaming machine 300. In addition, the height of the cabinet 102 may be selected so that the surface 104 holds the gaming machine 300 at a level or height that facilitates interaction with the gaming machine 300 by a person. Alternatively, legs (e.g., the legs 208 of FIG. 2) may be mechanically coupled to the cabinet 102 and configured to elevate the gaming machine 300 to a desired height to facilitate a person's comfortable interaction with the gaming machine 300.

The exhaust structure 106 may be configured to extend beyond the height of the gaming machine 300 so that processed air may be exhausted from the example presentation apparatus 100 via a flow path that flows freely into the surrounding area and that is not blocked, obstructed, or otherwise interfered with by the gaming machine 300. In addition, the exhaust structure 106 may be configured to cover, protect, and/or add at least partial support for the gaming machine 300. For example, the gaming machine 300 may be at least partially attached, coupled, or otherwise anchored to the exhaust structure 106 to prevent the gamine machine 300 from tipping over off of the surface 104.

FIG. 4 illustrates an example multi-presentation apparatus 400 used to hold a plurality of gaming machines 402. The function and operation of the example multi-presentation apparatus 400 may be substantially similar or identical to the example presentation apparatus 100 of FIGS. 1 and 3. The example multi-presentation apparatus 400 is generally configured to hold a plurality of objects such as, for example, the plurality of gaming machines 402 in a manner that facilitates a function or operation of the objects as described above in connection with FIG. 3.

The example multi-presentation apparatus 400 is shown in FIG. 4 as being composed of multiple presentation apparatus that are similar to the example presentation apparatus 100 (FIGS. 1 and 3). More specifically, the right-most part of the example multi-presentation apparatus 400 shown in FIG. 4 includes a first cabinet 404 and a second cabinet 406, both of which may be operatively coupled to an exhaust structure 408. In a similar manner, the left-most part of the example multi- presentation apparatus 400 shown in FIG. 4 includes a third cabinet 410 and a fourth cabinet (not shown) located opposite the third cabinet 410, both of which may be operatively coupled to an exhaust structure 412.

In an example implementation, the cabinets 404 and 410 may each be configured to hold at least a portion of an air processing apparatus. The cabinets 404 and 410 may include respective intake vents 414 and 416, which are substantially similar or identical to the intake vent 120 of FIG. 1. In addition, the exhaust structures 408 and 412 may be operatively coupled to the cabinets 404 and 410, respectively, to enable processed air to exit the example multi-presentation apparatus 400. In this example implementation, the example multi-presentation apparatus 400 may be configured to process (e.g., filter) ambient air using air processing apparatus (e.g., air filtration apparatus) held within the cabinets 404 and 410. A plurality of the example multi-presentation apparatus 400 may be arranged in a plurality of rows in a manner that allows the ambient air within each row between the example air processing apparatus to be processed.

In another example implementation, the cabinets 404, 406, 410, and the fourth cabinet may each be configured to hold a portion of an air processing apparatus. Additionally, the cabinets 404 and 406 may be operatively coupled to the exhaust structure 408 and the third cabinet 410 and the fourth cabinet may be operatively coupled to the exhaust structure 412. In this manner, ambient air may be processed from both sides of the example multi-presentation apparatus 400.

Although, the example multi-presentation apparatus 400 is shown as comprising a plurality of integrally formed presentation apparatus that are substantially similar to the example presentation apparatus 100, the multi-presentation apparatus 400 may be formed using a plurality of integrally formed presentation apparatus that are substantially similar or identical to the example presentation apparatus 200. Alternatively, the example multi-presentation apparatus 400 may be formed by arranging and/or coupling, in a side-by-side and back-to-back formation, a plurality of presentation apparatus that are substantially similar or identical to the example presentation apparatus 100 and/or the example presentation apparatus 200.

The example multi-presentation apparatus 400 includes a control panel 418 that is substantially similar or identical to the control panel 114 of FIG. 1. The control panel 418 may be used to control and/or monitor one or more of the air processing apparatus held in the example multi-presentation apparatus 400.

Although the example presentation apparatus 100 and the example multi-presentation apparatus 400 are shown as holding the gaming machines 300 and 402, the example presentation apparatus 100 and the example multi-presentation apparatus 400 may be configured to function as a kiosk, an information booth, an automated teller machine (ATM), and/or to hold a public telephone, an advertisement, a computer terminal, etc.

Figure 6:
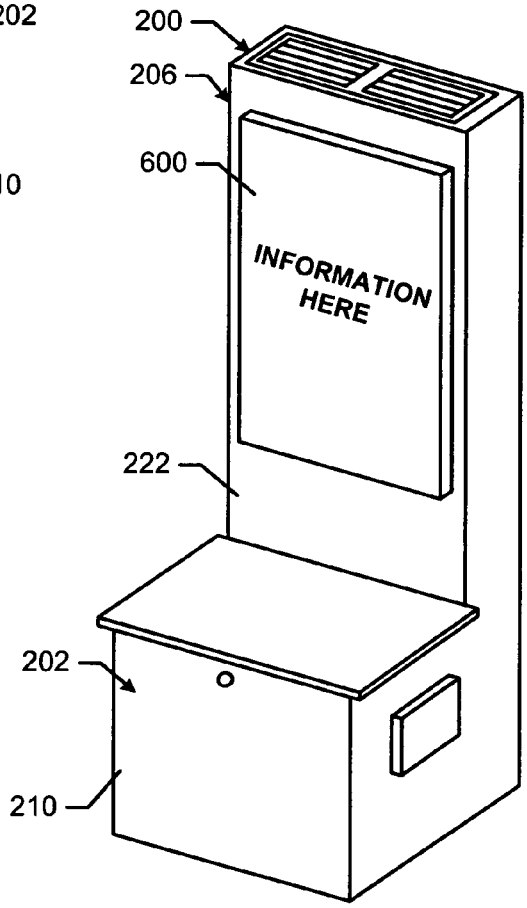

FIGS. 5 and 6 illustrate the example presentation apparatus 200 of FIG. 2 holding information displays (i.e., information displays 500 and 600, respectively). The example presentation apparatus 200 may be used to hold any object and may be configured to facilitate a function of the object. For example, as shown in FIGS. 5 and 6, the example presentation apparatus 200 may be used, for example, to hold objects that provide information to one or more persons. In addition, the example presentation apparatus 200 may be placed at any location at which it is desired to process (e.g., filter) ambient air.

In particular, FIG. 5 illustrates the example presentation apparatus 200 holding the information display 500. As shown, the information display 500 is placed on the surface 204 (FIG. 2) and may be located at a predetermined position that is defined by the exposed surface area of the surface 204. As shown, the exhaust structure 206 (FIG. 2) may be configured to extend beyond a top surface of the information display 500 to enable processed air to flow along a flow path that is adjacent to and/or substantially parallel with a back surface (not shown) of the information display 500.

FIG. 6 illustrates the example presentation apparatus 200 holding the information display 600. More specifically, the information display 600 is held or supported by the outer plenum surface 222 in a substantially predetermined position defined by the mechanical characteristics (e.g., size, angle, location, etc.) of the outer plenum surface 222.

As shown in FIG. 5, the surface 204, the base 210, and a portion of an air processing apparatus within the cabinet 202 are configured to cooperate functionally with the information displays 500. More specifically, the surface 204 is configured to hold the information display 500 at a location that does not interfere with the operation of the air processing apparatus. Additionally, the base 210 may be configured to hold the surface 204 at a height or elevation that enables the information display 500 to be used (e.g., viewed) by a person. The air processing apparatus (not shown) is configured to move air through the example presentation apparatus 200 in a manner that does not interfere with the space used by the information display 500. In particular, processed air moves via a flow path that does not interfere with an area around the example presentation apparatus 200 in which a person may be located while viewing the information display 500.

As shown in FIG. 6, the outer plenum surface 222, the base 21 0 and a portion of an air processing apparatus stored within the cabinet 202 are configured to cooperate functionally with a function of the information display 600. More specifically, the outer plenum surface 222 may be configured to hold the information display 600 at a location and in a manner that does not interfere with the operation of the air processing apparatus. Additionally, the outer plenum surface 222 may be configured to hold the information display 600 at a height or level that enables the information display 600 to be easily viewed by a person. The base 210 may be used to hold at least a portion of the air processing apparatus so that the air processing apparatus is not visibly intrusive with respect to the information display 600. Furthermore, the exhaust structure 206 and the cabinet 202 are configured to guide air about the information display 600 and a surrounding area within which a person may be located while viewing the information display 600. In this manner, the operation of the air processing apparatus is not visually intrusive, esthetically unappealing, etc. to one or more individuals viewing the information display 600.

As described above, the information displays 500 and 600 are held by the presentation apparatus 200 in a manner that allows a person to easily consume the information that is displayed thereon. The information displays 500 and 600 may include, for example, menus, advertisements, directories, artwork, etc. Additionally, although FIGS. 5 and 6 are shown as holding the information displays 500 and 600, the example presentation apparatus 200 may function as a kiosk, an information booth, an ATM, and/or to hold a public telephone, an advertisement, a computer terminal, etc.

Figure 7A:
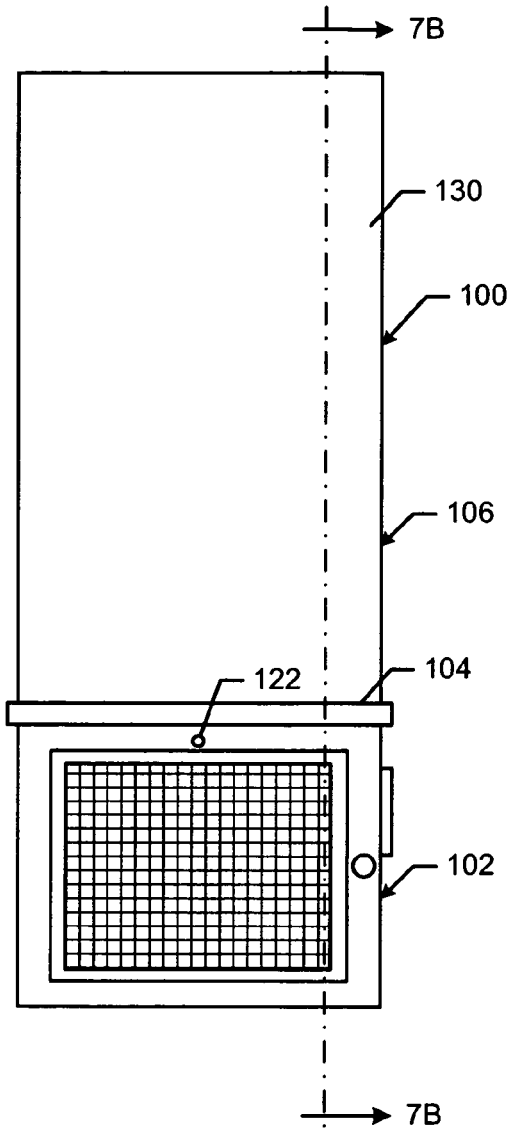
FIG. 7A is a front elevational view and FIG. 7B is a cross-sectional view of the example presentation apparatus of FIG. 1.
Figure 7B:
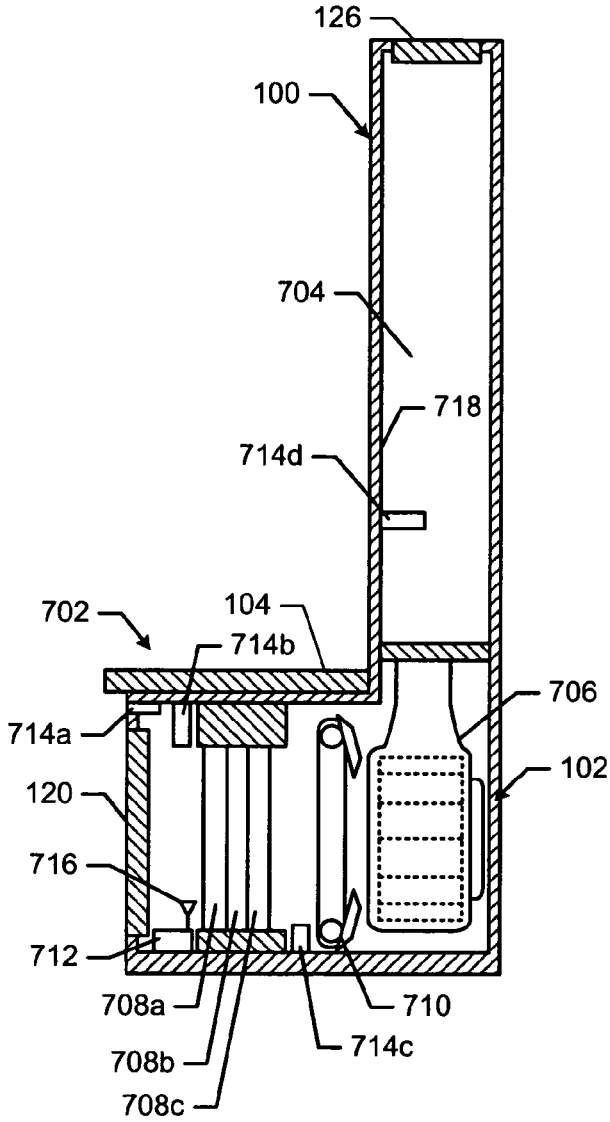

FIG. 7A is a front elevational view and FIG. 7B is a cross-sectional view of the example presentation apparatus 100 of FIG. 1. In particular, FIGS. 7A and 7B illustrate an example manner in which an air processing apparatus 702 may be integrated with the example presentation apparatus 100 and an air processing apparatus. As shown in FIG. 7B, the example air processing apparatus 702 may be implemented as an example air filtration apparatus 702 that is integrated within the example presentation apparatus 100. Although, the air processing apparatus is shown as the example air filtration apparatus 702, any other air processing apparatus may be integrated within the example presentation apparatus 100 including, for example, a deionizer, a humidifier, a dehumidifier, etc.

FIG. 7A illustrates a front view of the cabinet 102, the surface 104 disposed thereon, and the exhaust structure 106 extending beyond the cabinet 102. Mechanical dimensions of the example presentation apparatus 100 may be modified to suit a particular application and/or to enable the example presentation apparatus 100 to cooperate functionally with a function of an object to be placed on and/or held or supported by the surface 104 and/or the outer plenum surface 130 of the exhaust structure 106. For example, if an object to be placed on the surface 104 is relatively wide, the widths of the cabinet 102, the surface 104, and the exhaust structure 106 may be configured accordingly to suitably hold or support the object.

Heights of the exhaust structure 106 and the cabinet 102 may also be configured to suit one or more functions of an object. For example, in some instances, a height of the exhaust structure 106 may be reduced or increased based on a height of the object to be held by the surface 104. In other examples, the exhaust structure 106 may be eliminated and the exhaust vent 126 may be operatively coupled to the cabinet 102 or a portion of the surface 104 to enable processed air to exit the example presentation apparatus 100. A height of the cabinet 102 may also be configured to suit a particular functionality of the object. For example, if the gaming machine 300 (FIG. 3) is placed on the surface 104, the height of the cabinet 102 may be configured so that the gaming machine 300 is held or supported at a level or height that allows the gaming machine 300 to be easily interacted with by a person.

FIG. 7B illustrates a side sectional view of the example presentation apparatus 100. In particular, FIG. 7B illustrates the air filtration apparatus 702 and a plenum 704 (i.e., an exhaust plenum) through which the air filtration apparatus 702 exhausts processed or filtered air. The example air filtration apparatus 702 is a High Efficiency Particulate Air (HEPA) filtration apparatus and includes a fan 706, a plurality of air filter elements 708*a*, 708*b*, and 708*c* (i.e., the first filter 708*a*, the second filter 708*b*, and the third filter 708*c*), and an ultraviolet lamp 71 0 having one or more light elements (i.e., fluorescent tubes). In some implementations, the air filtration apparatus 702 may also include electronic apparatus to control operation of the air filtration apparatus 702. For example, the air filtration apparatus 702 may also include an information processing system 712 and a plurality of sensors 714*a*, 714*b*, 714*c*, and 714*d* (i.e., the first sensor 714*a*, the second sensor 714*b*, the third sensor 714*c*, and the fourth sensor 714*d*), each of which is communicatively coupled to the information processing system 712. Although, the air filtration apparatus 702 is shown as a HEPA filtration apparatus, any other air filtration apparatus may be used instead of or in addition to the HEPA filtration apparatus including, for example, an ionic air filtration apparatus.

As shown in FIG. 7B, the plenum 704 may be substantially perpendicular to the surface 104. In this manner, the plenum 704 may provide a flow path through which processed air may be exhausted from the example presentation apparatus 100 to substantially minimize or eliminate interference with a function of an object held by the surface 104.

The fan 706 may be a squirrel cage fan, or any other type of fan that may be configured to draw ambient air into the cabinet 102 through the air filters 708*a*-708*c* and push or exhaust processed air out of the example presentation apparatus 100 through the plenum 704. The fan 706 may be a variable speed fan that is communicatively coupled to and controllable by the information processing system 712. For example, as described in greater detail below, the speed of the fan 706 may be controlled based on information received by the information processing system 712 from one or more of the sensors 714*a*-714*d*.

The plurality of air filters 708*a*-708*c* may be arranged to sequentially filter ambient air that is drawn into the cabinet 102 by the fan 706. For example, the first filter 708*a* may be a pre-filter, the second filter 708*b* may be a HEPA filter, and the third filter 708*c* may be a charcoal filter. In particular, the first filter 708*a* may be an electrostatic filter or a pleated filter having antimicrobial properties. The first filter 708*a* may be used to pre-filter the ambient air that is drawn into the cabinet 102 to remove relatively large pollutants or particles (e.g., dust, lint, etc.) from the ambient air. The HEPA filter used to implement the second filter 708*b* may be used to capture many bacteria, viruses, allergens (e.g., pollens, spores, smoke, etc.), and other relatively small organisms or particles that may be found in ambient air. The charcoal filter used to implement the third filter 708*c* may be used to remove volatile organic compounds (VOC) (e.g., certain chemicals, gases, etc.) and odors from the ambient air.

The ultraviolet lamp 710 may be configured to sterilize, clean, or at least kill some organisms (e.g., bacteria) that are trapped by the third filter 708*c*. The ultraviolet lamp 710 is shown at a location that enables the ultraviolet lamp 710 to direct ultraviolet light toward the third filter 708*c*. However, the ultraviolet lamp 710 may be at any other location such as, for example, a location that allows the ultraviolet lamp 710 to direct ultraviolet light toward the first filter 708*a*. In addition, although only one ultraviolet lamp is shown, any number of ultraviolet lamps may be located within the example presentation apparatus 100.

Figure 15:
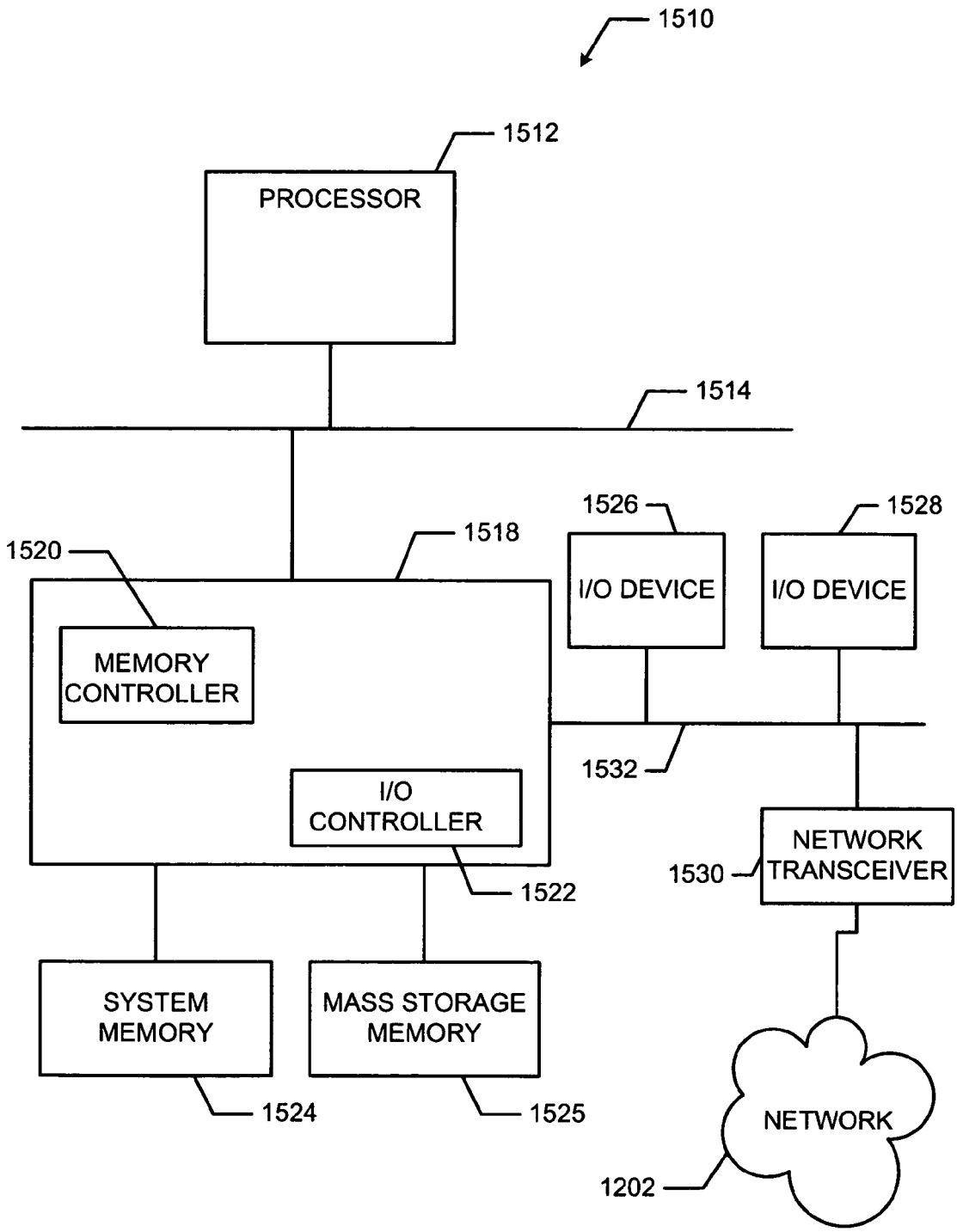
FIG. 15 is a block diagram of an example processor system that may be used to implement the example processing systems and associated methods described herein.

The information processing system 712 may be implemented using any processing system (e.g., a computer, an application specific integrated circuit (ASIC), the processor system 1510 of FIG. 15, etc.) that is capable of controlling and/or monitoring operations of the air filtering apparatus 702. The information processing system 712 may be communicatively coupled to the control panel 114 of FIG. 1 and configured to receive commands entered via the control panel 114 by a person. In addition, the information processing system 712 may be configured to display information via the control panel 114.

The information processing system 712 may be communicatively coupled to an antenna 716 that enables the information processing system 712 to be communicatively coupled to one or more other information processing systems. For example, the information processing system 712 may be communicatively coupled to a central processing system (e.g., the central processing system 1204 of FIG. 12). Additionally or alternatively, the information processing system 712 may be communicatively coupled to an information processing system of another presentation apparatus. In this manner, a plurality of presentation apparatus may be configured to form a network via their respective information processing systems each of which may be substantially similar or identical to the information processing system 712.

The plurality of sensors 714*a*-714*b* may be used to monitor various characteristics of ambient air and processed air that is moved through the example presentation apparatus 100. The first sensor 714*a* may be mechanically coupled to the sensor aperture 122 (FIGS. 1 and 7A) and configured to detect characteristics of the environment outside of the example presentation apparatus 100. For example, the first sensor 714*a* may be a smoke sensor that detects if smoke (e.g., cigarette smoke) is present in the ambient air. An electrical signal corresponding to an amount of smoke in the ambient air may be communicated by the first sensor 714*a* to the information processing system 712. The information processing system 712 may be programmed or configured to increase the speed of the fan 706 in response to smoke in the ambient air to filter an increased amount of ambient air. Alternatively, the first sensor 714*a* may be any other type of environmental sensor or combination of sensors configured to sense chemicals, particles, gases, or any other characteristics associated with the quality of ambient air.

In an alternative configuration, the first sensor 714*a* may be a microphone configured to sense a level of noise in the surrounding area within which the example presentation apparatus 100 is located. In this case, the first sensor 714*a* may communicate an electrical signal associated with an ambient noise level to the information processing system 712. The information processing system 712 may be programmed or configured to control a speed of the fan 706 in response to the ambient noise level in a surrounding area within which the example presentation apparatus 100 is located. For example, it may be desired to operate the example presentation apparatus 100 in a manner that is as quiet as possible within a given environment. More specifically, if the example presentation apparatus 100 is located within a restaurant lobby, a hotel lobby, etc., it may be desirable to maintain the operating noise of the example presentation apparatus 100 at levels that are relatively imperceptible compared to the surrounding noise produced by, for example, people. Thus, varying a speed of the fan 706 based on a noise level may cause any noise emitted by the operation of the example presentation apparatus 100 to be substantially masked by the noise level of the surrounding area.

When more people are present in the surrounding or ambient area within which the example presentation apparatus 100 is located, a surrounding or ambient noise level increases. Additionally, the quality of the ambient air is prone to degrade at a faster rate when more people are present. The noise-level-controlled mode described above enables the air filtration apparatus 702 to operate at higher air filtration levels when more people are present. Thus, controlling the operation of the air filtration apparatus 100 based on a surrounding noise level may be used to enable the air filtration apparatus 702 to filter air in a very efficient manner.

The second sensor 714*b* may be mechanically coupled to the cabinet 102 as shown in FIG. 7B and may be implemented using a particulate sensor, an air flow sensor, or any other sensor associated with detecting a desired characteristic of the ambient air that is drawn into the cabinet 102. For example, the fan 706 may be configured to operate continuously at a low speed and to continuously draw ambient air into the cabinet 102. In the case a particulate sensor is used to implement the second sensor 714*b*, the second sensor 714*b* may be used to sense or detect particles in the ambient air that is drawn into the cabinet 102. An electrical signal associated with a number or density of particles in the ambient air may be communicated to the information processing system 712. The information processing system 712 may be configured or programmed to control the speed of the fan 706 based on the electrical signal received from the second sensor 714*b*. In this manner, as the number or density of particles in the ambient air increases, the fan 706 may operate to filter the ambient air accordingly.

In the case an air flow sensor is used to implement the second sensor 714*b*, the information processing system 712 can receive signals form the second sensor 714*b* to determine air flow information such as air flow velocity and/or volume associated with ambient air drawn into the cabinet 102. In this manner, the information processing system 712 may determine if the intake vent 120 is clogged and/or requires replacement or cleaning. Additionally, the air flow rate may indicate if any of the filters 708*a*-708*c* requires cleaning or replacement. Further, the air flow information may be used by the information processing system 712 to determine if the fan 706 is properly operating.

The third sensor 714*c* may be mechanically coupled to the cabinet 102 as shown in FIG. 7B and may be implemented using a particulate sensor, an air flow sensor, or any other sensor for detecting a desired characteristic of the air that is drawn through the filters 708*a*-708*c*. The third sensor 714*c* may communicate with the information processing system 712 and may be used in combination with operations of the air filtration apparatus 702 in a substantially similar or identical manner as described above in connection with the second sensor 714*b*.

The fourth sensor 714*d* may be mechanically coupled to an inner surface 718 of the plenum 704 and may be implemented using an air flow sensor, a particulate sensor, or any other sensor configured to sense or detect a desired characteristic of processed air that is exhausted from the example presentation apparatus 100. The third sensor 714*c* may communicate with the information processing system 712 and may be used in combination with operations of the air filtration apparatus 702 in a substantially similar or identical manner as described above in connection with the second sensor 714*b*.

An example method for determining a replacement time for one or more of the filters 708*a*-708*c* may be implemented by using an air flow sensor to implement one or more of the sensors 714*b*-714*d*. More specifically, the information processing system 712 may be configured or programmed to perform calculations based on operation time and air flow information to determine a condition of one or more of the filters 708*a*-708*c*. More specifically, the information processing system 712 may determine when one or more of the filters 708*a*-708*c* needs to be replaced or cleaned.

Air filters may be rated for operation based on an amount of time or a volume of air that is processed. In one example, an air filter may be rated to operate for a predetermined amount of time (at a constant flow) before needing to be cleaned or replaced. The information processing system 712 may be configured to accumulate a total time of operation for each of the filters 708*a*-708*c* and the flow rates during that time, then assert an alarm or alert via, for example, the control panel 114 (FIG. 1) that suggests when to change or clean one or more of the filters 708*a*-708*c*.

In an alternative example involving the use of air filters that are rated based on a volume of processed air, the information processing system 712 may be used to determine the volume of air that has been processed by the plurality of filters 708*a*-708*c*. In this manner, the information processing system 712 may assert an alarm or alert indicating when to change or clean one or more of the filters 708*a*-708*c*.

In addition, the information processing system 712 may be configured to use electrical signals from a particulate sensor in addition to electrical signals from an air flow sensor to determine when one or more of the air filters 708*a*-708*c* need to be cleaned or replaced. In this manner, the information processing system 712 may use the quality of the ambient air to determine if the time between filter replacements or cleanings can be extended or needs to be shortened. For example, an environment having relatively poor air quality conditions may require that the air filters 708*a*-708*c* be cleaned or replaced more often than an environment having relatively good air quality conditions.

Figure 8A:
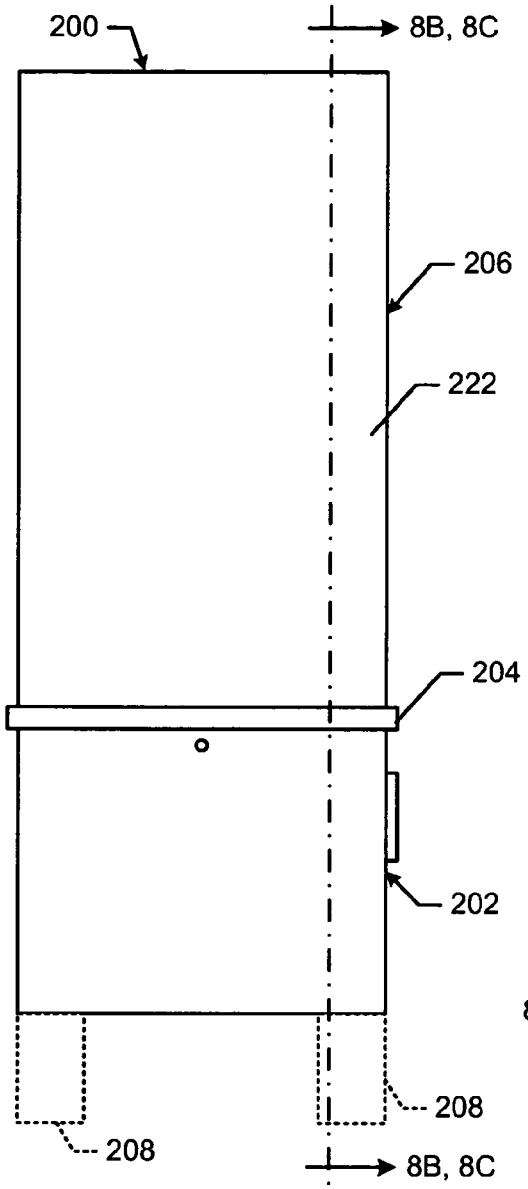
FIG. 8A is a front elevational view and FIGS. 8B and 8C are cross-sectional views of alternate configurations of the example presentation apparatus of FIG. 2.
Figure 8B:
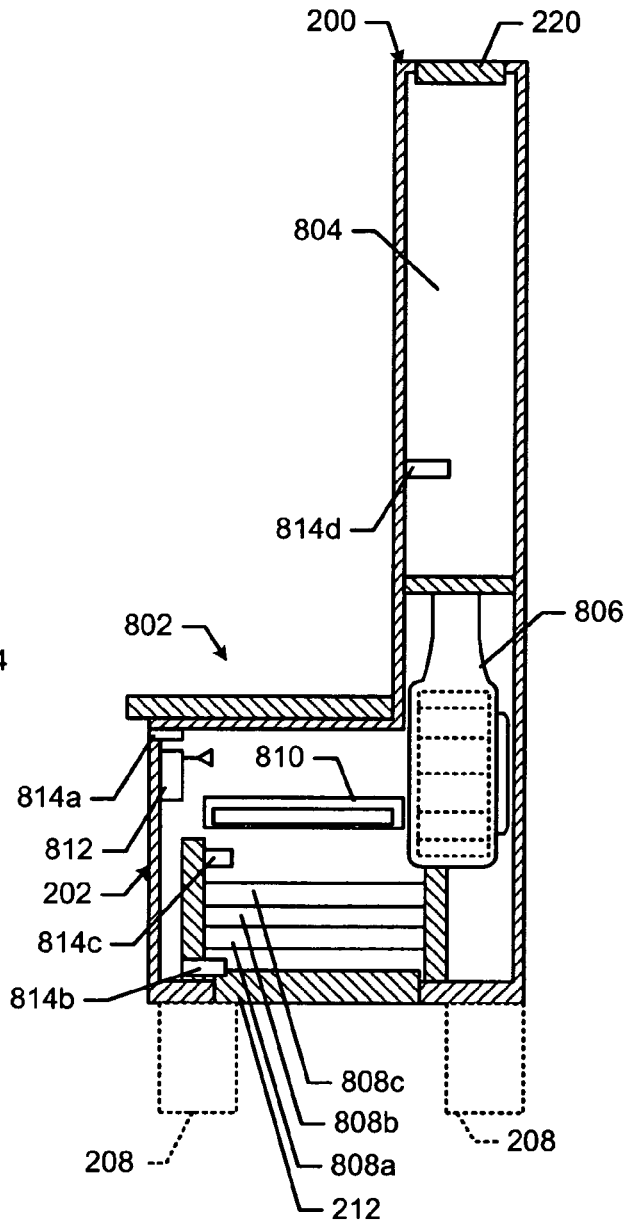
Figure 8C:
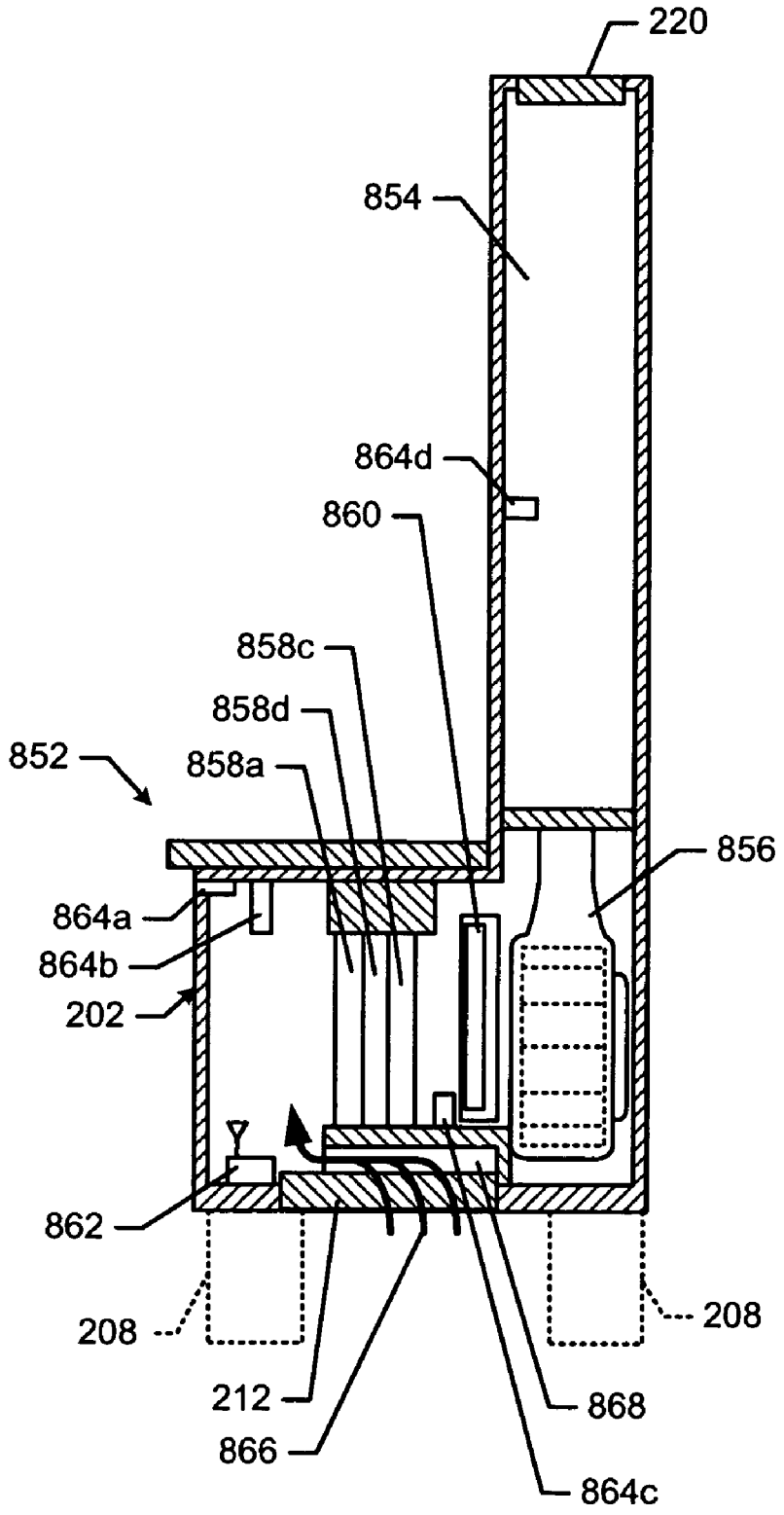

FIG. 8A is a front elevational view and FIGS. 8B and 8C are cross-sectional views of alternate configurations of the example presentation apparatus 200 of FIG. 2. In particular, FIGS. 8A, 8B, and 8C illustrate an example manner in which an air processing apparatus may be integrated within the example presentation apparatus 200. As shown in FIGS. 8B and 8C, the air processing apparatus integrated within the example presentation apparatus 200 may be an example air filtration apparatus 802 (FIG. 8B) or an example air filtration apparatus 852 (FIG. 8C). Although, the air processing apparatus is shown as the example air filtration apparatus 802 and 852, any other air processing apparatus may be integrated within the example presentation apparatus 200 including, for example, a deionizer, a humidifier, a dehumidifier, etc.

FIG. 8A illustrates a front view of the cabinet 202, the surface 204, and the exhaust structure 206 which extends away from the cabinet 202. The legs 208 may be mechanically coupled to the cabinet 202 as shown to elevate the example presentation apparatus 200 and to allow ambient air to be drawn into the cabinet 202 via the intake vent 212 (FIGS. 2, 8B, and 8C). Mechanical dimensions of the example presentation apparatus 200 may be modified to suit a particular application or to enable the example presentation apparatus 200 to cooperate functionally with a function of an object being held by the surface 204 and/or the outer plenum surface 222. For example, if an object to be placed on the surface 204 and/or the outer plenum surface 222 is relatively wide, the widths of the cabinet 202, the surface 204, and the exhaust structure 206 may be configured to hold or support the object.

The heights of the exhaust structure 206 and the cabinet 202 may also be configured to suit a particular function of an object. For example, in some instances, the height of the exhaust structure 206 may be reduced or increased according to a height of the object being held by the surface 204 and/or the outer plenum surface 222. In other examples, the exhaust structure 206 may be eliminated and the exhaust vent 220 (FIGS. 2, 8B, and 8C) may be operatively coupled to the cabinet 202 or a portion of the surface 204 to enable processed air to exit the example presentation apparatus 200. A height of the cabinet 202 may also be configured to suit a particular function of the object. For example, if the information display 500 (FIG. 5) is placed on the surface 204, the height of the cabinet 202 may be configured to enable the surface 204 to hold or support the information display 500 at a level or height that allows the information display 500 to be easily viewed by a person. In another example, if the information display 600 (FIG. 6) is held by the outer plenum surface 222, a height of the outer plenum surface 222 may be configured to hold the information display 600 at a height and in a manner that allows the information display 600 to be easily viewed by a person.

In addition, although the exhaust structure 206 is shown as being substantially perpendicular to the surface 204, the exhaust structure 206 may be configured to extend away from the surface 204 and/or the cabinet 202 at any desired angle. For example, the exhaust structure 206 may be configured to extend at an angle that enables the information display 600 (FIG. 6) to be displayed at an ergonomically viewable angle.

FIG. 8B is an example cross-sectional view of the example presentation apparatus 200 and FIG. 8C is another example cross-sectional view of the example presentation apparatus 200. The example cross-sectional views in FIGS. 8B and 8C illustrate example air processing apparatus that may be integrated within the cabinet 202 of the example presentation apparatus 200 and that are positioned in alternate configurations relative to the intake vent 212.

As shown in FIG. 8B, the example presentation apparatus 200 may include the example air filtration apparatus 802 and a plenum 804 (i.e., an exhaust plenum) through which the air filtration apparatus 802 may exhaust processed (e.g., filtered) air. In the alternative configuration depicted in FIG. 8C, the example presentation apparatus 200 may include the example air filtration apparatus 852 and a plenum 854 (i.e., an exhaust plenum) through which the air filtration apparatus 852 may exhaust processed air. The configurations and operations of the example air filtration operations of the example air filtration apparatus 702 described above in connection with FIG. 7B. More specifically, the example air filtration apparatus 802 includes a fan 806, a plurality of air filter elements 808*a*, 808*b*, and 808*c*, an ultraviolet lamp 810, an information processing system 812, and a plurality of sensors 814*a*, 814*b*, 814*c*, and 814*d*, each of which is respectively substantially similar or identical to the fan 706, the plurality of filters 708*a*, 708*b*, and 708*c*, the ultraviolet lamp 710, the information processing system 712, and the plurality of sensors 714*a*, 714*b*, 714*c*, and 714*d* described above in connection with FIG. 7B. In a similar manner, the example air filtration apparatus 852 includes a fan 856, a plurality of air filter elements 858*a*, 858*b*, and 858*c*, an ultraviolet lamp 860, an information processing system 862, and a plurality of sensors 864*a*, 864*b*, 864*c*, and 864*d*, each of which is respectively substantially similar or identical to the fan 706, the plurality of filters 708*a*, 708*b*, and 708*c*, the ultraviolet lamp 710, the information processing system 712, and the plurality of sensors 714*a*, 714*b*, 714*c*, and 714*d*.

As shown in FIG. 8B, ambient air is drawn into the cabinet 202 by the fan 806 through the intake vent 212 and may be drawn directly into the filters 808*a*-808*c*, which are positioned so that the faces of the filters 808*a*-808*c* are substantially parallel relative to the intake vent 212. In contrast, as shown in FIG. 8C, ambient air drawn into the cabinet 202 by the fan 856 via the intake vent 212 in a direction generally indicated by arrow 866 is diverted or otherwise guided within a passage 868. In this manner, the ambient air may be drawn through the filters 858*a*-858*c*, which are positioned so that the faces of the filters 858*a*-858*c* are perpendicular relative to the intake vent 212.

Figure 9:
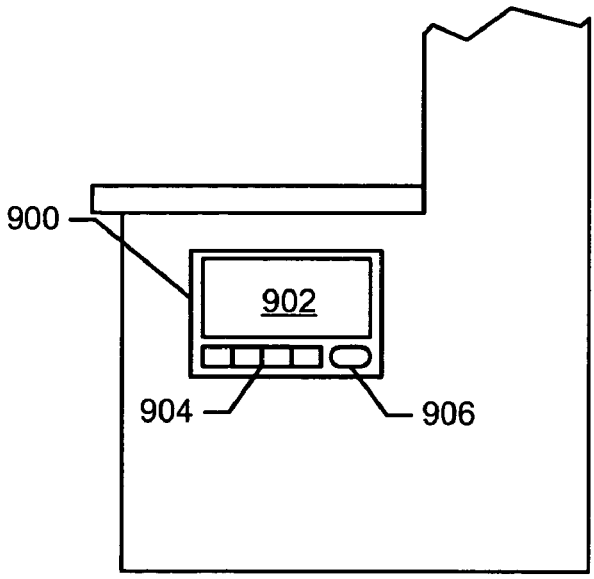
FIGS. 9 and 10 depict example control panels that may be used with the example presentation apparatus of FIGS. 1 and 2.
Figure 10:
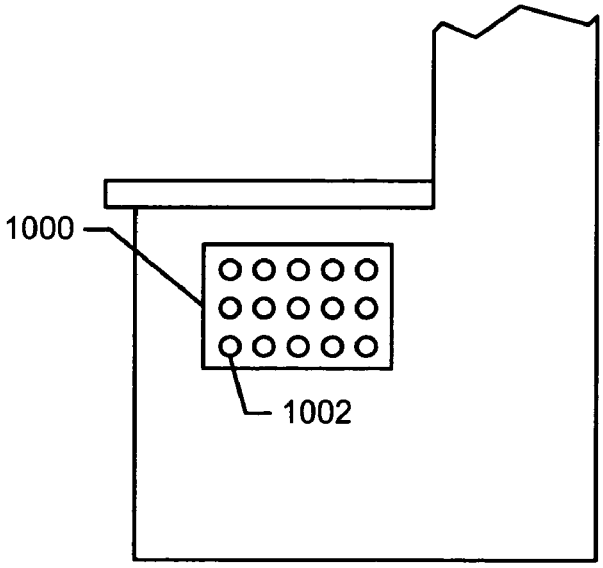

FIGS. 9 and 10 depict example control panels 900 and 1000 that may be used with the example presentation apparatus 100 and 200 of FIGS. 1 and 2. In particular, the example control panels 900 and 1000 may be used to implement the example control panels 114 and 214 of FIGS. 1 and 2 and may be communicatively coupled to any of the information processing systems 712, 812, and 862 described above in connection with FIGS. 7B, 8B, and 8C, respectively. The example control panels 900 and 1000 may be configured to display information and/or receive inputs associated with monitoring, controlling, operating, etc. any aspect of an example presentation apparatus (e.g., the example presentation apparatus 100 of FIG. 1, the example presentation apparatus 200 of FIG. 2, or the example multi-presentation apparatus 400 of FIG. 4). In instances in which a plurality of example presentation apparatus are communicatively coupled via a network (e.g., the network 1202 described below in connection with FIG. 12), the example control panels 900 and 1000 may be used to interact with any one or more of the example presentation apparatus communicatively coupled to the network.

As shown in FIG. 9, the example control panel 900 includes a display 902, a plurality of buttons 904, and an I/O interface 906. The display 902 may be used to display information associated with one or more example presentation units including respective air processing apparatus. The display 902 may be implemented using a liquid crystal display (LCD), a plasma-based display, a cathode ray tube (CRT) display, a light emitting diode (LED) display, etc. The plurality of buttons 904 may be used to provide information to, for example, one or more of the information processing systems 710, 810, and 860 of FIGS. 7B, 8B, and 8C, respectively.

The I/O interface 906 may be used to enable bi-directional wired or wireless communication between a handheld device (e.g., a remote maintenance device) and, for example, one or more information processing systems (e.g., the information processing systems 710, 810, and 860 of FIGS. 7B, 8B, and 8C, respectively) of one or more example presentation apparatus. A remote maintenance device may be any handheld device (e.g., a handheld computer terminal, a personal digital assistant, etc.) that may be used to monitor and/or control operations of air processing apparatus held within presentation apparatus. The I/O interface 906 may be implemented using an infrared transceiver and/or an antenna (e.g., a patch antenna). In some implementations, the I/O interface 906 may be mechanically coupled to one of the example presentation apparatus described herein and the remainder of a control panel may be omitted. In this manner, various operations of the presentation apparatus may only be controlled via a remote maintenance device. If the I/O interface 906 is implemented using an infrared transceiver, a user may hold a remote maintenance device in alignment with the I/O interface 906 to interact with one or more example presentation apparatus. If the I/O interface 906 is implemented using an antenna, a user may interact with one or more example presentation apparatus by holding a remote maintenance device in an area within which an example presentation apparatus is located. The I/O interface 906 is implemented using any suitable wireless communication protocol including, for example, 802.11, Bluetooth, etc.

The example control panel 1000 of FIG. 10 may include a plurality of buttons 1002. The buttons 1002 may be used to monitor and/or control operations of one or more example presentation units. For example, the buttons 1002 may be implemented using light emitting buttons that provide information and that may be actuated to enter information to an information processing system (e.g., the information processing system 712 of FIG. 7B.

Figure 11A:
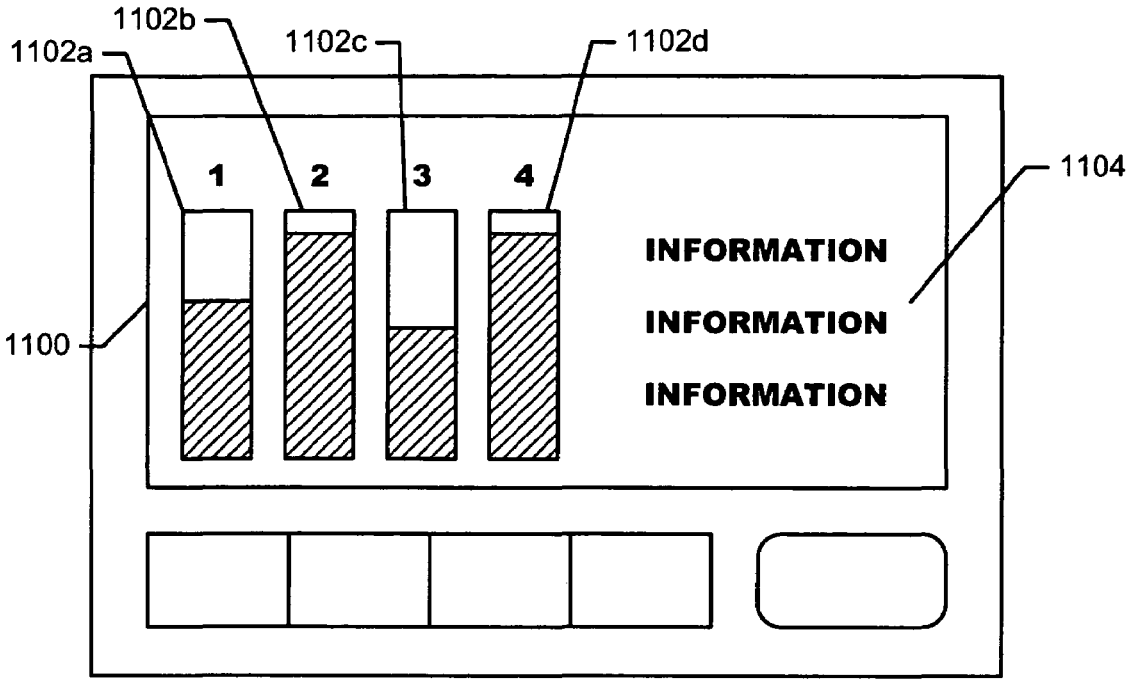
FIGS. 11A and 11B are example displays that may be used with the example control panel of FIG. 9.
Figure 11B:
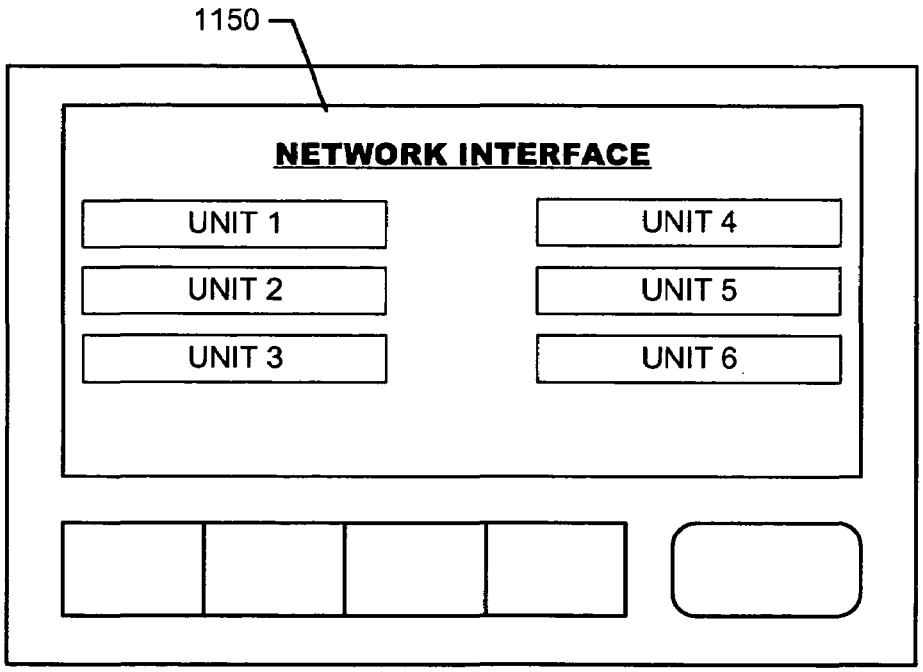

FIGS. 11A and 11B are example displays 1100 and 1150 that may be used with the example control panel 900 of FIG. 9. The example displays 1100 and 1150 depict, by way of example, applications that may be used to interact with example presentation apparatus and their respective air processing apparatus. In particular, the example display 1100 depicts an air filter monitoring display that may be used to monitor the status (e.g., the condition or remaining operation time) for each of a plurality of filters such as the filters 708*a*-708*c* and the large particle filter of the intake vent 120 of FIG. 7. The status may be used to determine when any one of the plurality of filters requires cleaning or replacement. For example, the filters may require periodic cleaning based on, for example, a volume of air that is typically filtered during operation. Additionally, any of the plurality of filters 708*a*-708*c* and the large particle filter of the intake vent 120 may require replacement when the filter is substantially clogged or deteriorated such that cleaning would not render the filter useful. Cleaning or replacement requirements may be determined based on a plurality of bars 1102*a*, 1102*b*, 1102*c*, and 1102*d*, each of which corresponds to one of a plurality of filters associated with an air filtration apparatus. In addition, supplemental information 1104 may be used to display information associated with any aspect of an air filtration apparatus (e.g., maintenance history, fan speed, air quality, etc.)

The example display 1150 depicts a network interface that may be used to select any presentation apparatus among a plurality of networked example presentation apparatus. In this manner, any presentation apparatus that is communicatively coupled to a network (e.g., the network 1202 of FIG. 12) may be controlled and/or monitored from one control panel. The example displays 1100 and 1150 merely depict example applications that may be used to interact with example presentation apparatus and respective air processing apparatus. Of course, displays associated with any other application, process, and/or operation may be displayed via the example control panel 900 (FIG. 9) and used to interact with one or more presentation apparatus.

Figure 12:
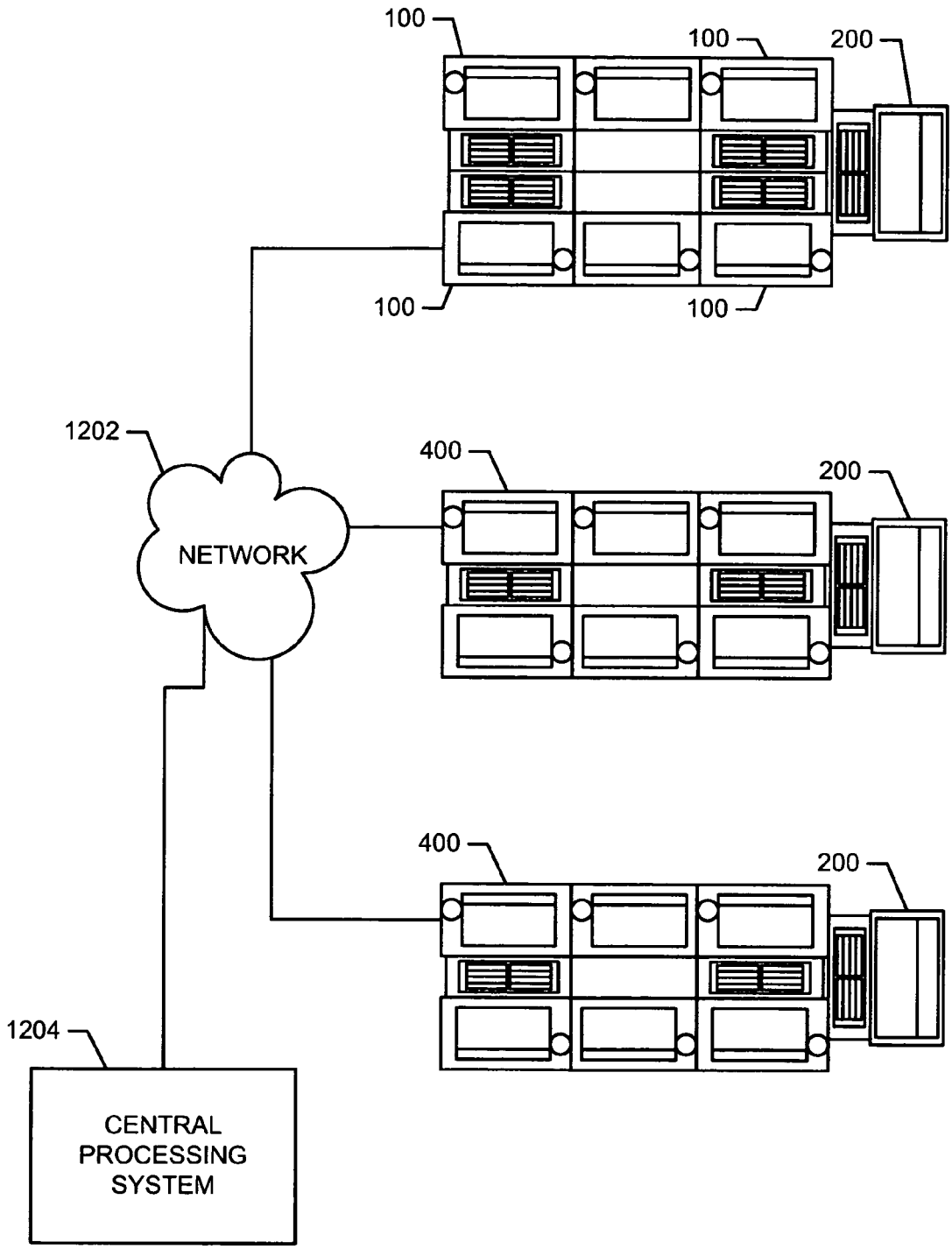
FIG. 12 illustrates networking capabilities of the example presentation apparatus of FIGS. 1, 2, and 4.

FIG. 12 illustrates networking capabilities of the example multi-presentation apparatus 100, 200, and 400 of FIGS. 1, 2, and 4, respectively. The example multi-presentation apparatus 100, 200, and 400 may be communicatively coupled to one another via respective information processing systems (e.g., the information processing systems 712, 812, and 862 of FIGS. 7B, 8B, and 8C, respectively). Additionally or alternatively, the example multi-presentation apparatus 100, 200, and 400 may be communicatively coupled to a network 1202 via respective information processing systems, which may be configured to communicate with a central processing system 1204.

The network 1202 may be implemented using any suitable wireless or wired network including, for example, an Ethernet network, an 802.11 network, a Bluetooth network, an infrared network, the Internet, etc. For example, each of the example multi-presentation apparatus 100, 200, and 400 may be communicatively coupled to the network 1202 via the antenna 716 described above in connection with FIG. 7B.

The central processing system 1204 may be implemented using any suitable information processing system including, for example, the example processor system 1510 described below in connection with FIG. 15. The central processing system 1204 may be communicatively coupled to the network 1202 as depicted in FIG. 12.

The example multi-presentation apparatus 100, 200, and 400 may be distributed throughout an area or space and may be monitored and/or controlled from one or more of the example multi-presentation apparatus 100, 200, and 400 via, for example, a control panel (e.g., the example control panels 114 and 214 of FIGS. 1 and 2, respectively). Alternatively or additionally, the central processing system 1204 may be located in a control room and may be used to monitor and/or control one or more of the example multi-presentation apparatus 100, 200, and 400 via the network 1202.

Figure 13:
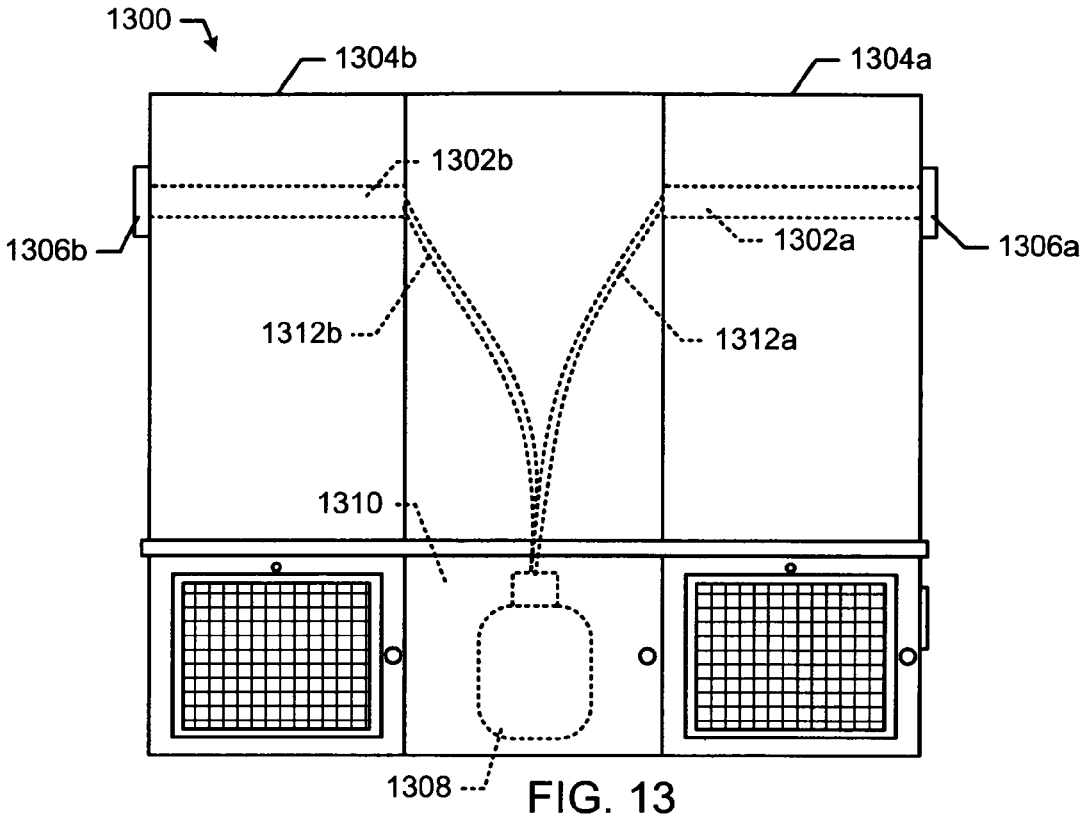
FIGS. 13 and 14 are example multi-presentation apparatus configured to exhaust scented air.
Figure 14:
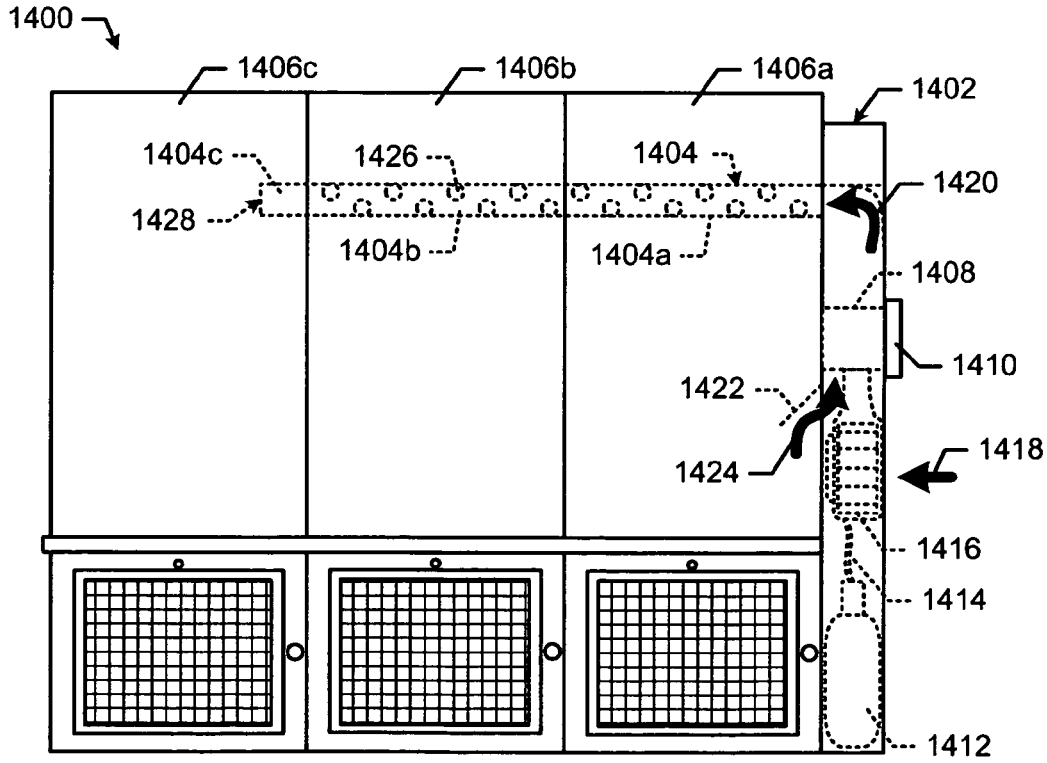

FIGS. 13 and 14 are example multi-presentation apparatus 1300 and 1400 configured to exhaust scented air. In particular, the example multi-presentation apparatus 1300 and 1400 are configured to condition processed (e.g., filtered) air with a scented chemical. In this manner, as the processed air is exhausted from the example presentation apparatus 1300 and 1400, the processed air aromatizes the surrounding ambient air. Although the example multi-presentation apparatus 1300 and 1400 are shown in FIGS. 13 and 14, single presentation apparatus such as, for example, the example presentation apparatus 100 and 200 of FIGS. 1 and 2 may also be configured to condition processed air.

The example multi-presentation apparatus 1300 shown in FIG. 13 includes scent apparatus 1302*a* and 1302*b* installed in exhaust plenums 1304*a* and 1304*b* in a manner that allows processed air to pass through or adjacent the scent apparatus 1302*a* and 1302*b*. The scent apparatus 1302*a* and 1302*b* may be implemented using any scenting chemical and/or technology. For example, the scent apparatus 1302*a* and 1302*b* may be implemented using a scent gel, a scent wax, a scent liquid, or any other suitable scent carrier configured to mask and/or neutralize odors. The scent apparatus 1302*a* and 1302*b* may be configured to accept scent trays or removable scent packs that can be installed and removed via access provided by maintenance doors 1306*a* and 1306*b*.

In an alternative example configuration, a chemical supply container 1308 may be stored in a center cabinet 1310 and may be configured to hold a scent liquid or a scent gel. The scent liquid or gel may be pumped to the scent apparatus 1302*a* and 1302*b* via delivery tubes 1312*a* and 1312*b* using one or more scent pumps (not shown) located in the center cabinet 1310 or in the scent apparatus 1302*a* and 1302*b*.

The scent apparatus 1302*a* and 1302*b* may also include excitation apparatus that facilitate delivery of the scented chemicals. For example, if a scent gel is used, the scent apparatus 1302*a* and 1302*b* may include heating elements (not shown) to heat the scent gel to facilitate delivery of the scent into the processed air as the processed air passes adjacent to or over the scent gel. In the case of a scent liquid, the scent apparatus 1302*a* and 1302*b* may include an atomizer (not shown) configured to atomize the scent liquid and spray it into the flow path of the processed air.

The example multi-presentation apparatus 1400 shown in FIG. 14 is operatively coupled to a scent dispenser 1402. The scent dispenser 1402 is configured to generate scented air and exhaust the scented air through a permeable plenum 1404 positioned within exhaust plenums 1406*a*, 1406*b*, and 1406*c*. In this manner, the scented air from the scent dispenser 1402 can be dispersed into processed air flowing through the exhaust plenums 1406*a*, 1406*b*, and 1406*c*.

The scent dispenser 1402 includes a chemical receptacle 1408 configured to hold a scent chemical such as, for example, a scent gel, a scent wax, a scent liquid, etc. The chemical receptacle 1408 may be configured to accept scent trays or removable scent packs that can be installed and removed via access through maintenance door 1410. Alternatively, a scented chemical (e.g., a scented gel or a scented liquid) may be stored in a chemical supply container 1412 stored within the scent dispenser 1402 and supplied via delivery tubes 1414 to the chemical receptacle 1408. The chemical receptacle 1408 may also include an excitation apparatus (not shown) to facilitate dispersal of the scented chemicals. The excitation apparatus may be, for example, a heating element or an atomizer as described above in connection with FIG. 13.

The scent dispenser 1402 may include a fan or blower 1416 configured to draw ambient air into the scent dispenser 1402 via an aperture (not shown) formed therein in a direction generally indicated by arrow 1418. The fan 1416 may push or blow the ambient air through or adjacent to the chemical receptacle 1408 to generate scented air that is pushed or forced via a flow path generally indicated by arrow 1420 into the permeable plenum 1404.

In an alternative implementation, the scent dispenser 1402 may be configured without the fan 1416 and may instead be configured to receive processed air from the exhaust plenum 1406*a*. In this implementation, an air guide 1422 may be provided on a side wall of the exhaust plenum 1406*a* and/or a side wall of the scent dispenser 1402 and may protrude through the side wall of the exhaust plenum 1406a. In either case, apertures (not shown) are formed in opposing side walls of the exhaust plenum 1406*a* and the scent dispenser 1402 so that processed air is guided by the air guide 1422 and forced into the scent dispenser 1402 in a direction generally indicated by arrow 1424. The processed air can then flow through or adjacent the chemical receptacle 1408 to generate scented air that is pushed or forced via the flow path generally indicated by the arrow 1420 into the permeable plenum 1404.

As shown in FIG. 14, the permeable plenum 1404 has three dispersal zones that include a first dispersal zone 1404*a* located in the first plenum 1406*a*, a second dispersal zone 1404*b* located in the second plenum 1406*b*, and a third dispersal zone 1404*c* located in the third plenum 1406*c*. The first and second dispersal zones 1404*a* and 1404*b* include dispersal apertures 1426 that allow scented air to be dispersed into the exhaust plenums 1406*a* and 1406*b*. The third dispersal zone 1404*c* includes an open end 1428 that allows the scented air to be dispersed into the exhaust plenum 1406*c*. Although, the third dispersal zone 1404*c* is shown as extending partially through the exhaust plenum 1406*c* and having none of the dispersal apertures 1426, the third dispersal zone 1404*c* may be configured to extend the width of the exhaust plenum 1406*c* and have the dispersal apertures 1426 formed therein.

FIG. 15 is a block diagram of an example processor system 1510 that may be used to implement the example processing systems (e.g., the information processing systems 712, 812, and 862 of FIGS. 7B, 8B, and 8C, respectively, and the central processing system 1204 of FIG. 12) and associated methods described herein. As shown in FIG. 15, the processor system 1510 includes a processor 1512 that is coupled to an interconnection bus or network 1514. The processor 1512 may be any suitable processor, processing unit, or microprocessor. Although not shown in FIG. 15, the system 1510 may be a multi-processor system and, thus, may include one or more additional processors that are substantially similar or identical to the processor 1512 and which are coupled to the interconnection bus or network 1514.

The processor 1512 of FIG. 15 is coupled to a chipset 1518, which includes a memory controller 1520 and an input/output (I/O) controller 1522. As is well known, a chipset typically provides I/O and memory management functions as well as a plurality of general purpose and/or special purpose registers, timers, etc. that are accessible or used by one or more processors coupled to the chipset. The memory controller 1520 performs functions that enable the processor 1512 (or processors if there are multiple processors) to access a system memory 1524 and a mass storage memory 1525.

The system memory 1524 may include any desired type of volatile and/or non-volatile memory such as, for example, static random access memory (SRAM), dynamic random access memory (DRAM), flash memory, read-only memory (ROM), etc. The mass storage memory 1525 may include any desired type of mass storage device including hard disk drives, optical drives, tape storage devices, etc.

The I/O controller 1522 performs functions that enable the processor 1512 to communicate with peripheral input/output (I/O) devices 1526 and 1528 and a network transceiver 1530 via an I/O bus 1532. The I/O devices 1526 and 1528 may be any desired type of I/O device such as, for example, a keyboard, a video display or monitor, a mouse, etc. While the memory controller 1520 and the I/O controller 1522 are depicted in FIG. 15 as separate functional blocks within the chipset 1518, the functions performed by these blocks may be integrated within a single semiconductor circuit or may be implemented using two or more separate integrated circuits.

The network transceiver 1530 may be any type of wired or wireless transceiver (e.g., an Ethernet transceiver, an 802.11 transceiver, a Bluetooth transceiver, as telephone modem, a cable modem, a DSL modem, etc.) suitable for communicatively coupling the processor system 1510 to the network 1202 described above in connection with FIG. 12.

The methods described herein may be implemented using instructions stored on a computer readable medium that are executed by the processor 1512. The computer readable medium (i.e., machine accessible medium) may include any desired combination of solid state, magnetic, and/or optical media implemented using any desired combination of mass storage devices (e.g., disk drive), removable storage devices (e.g., floppy disks, memory cards or sticks, etc.), and/or integrated memory devices (e.g., random access memory, flash memory, etc.).

Although certain apparatus, methods, and articles of manufacture have been described herein, the scope of coverage of this patent is not limited thereto. To the contrary, this patent covers all apparatus, methods, and articles of manufacture fairly falling within the scope of the appended claims either literally or under the doctrine of equivalents.

What is claimed is:

1. A presentation apparatus, comprising:

a base;

a surface coupled to the base and configured to hold a gaming machine, wherein the base and the surface are configured to facilitate use of the gaming machine by a person;

a portion of an air processing apparatus disposed within the base and configured to move ambient air through the base to generate processed air;

an exhaust structure operatively coupled to the base and having a plenum and an outer plenum surface, wherein the exhaust structure is configured to enable the processed air to be moved through the plenum via a flow path that is spatially associated with a substantially predetermined position of the gaming machine, and wherein the outer plenum surface is substantially perpendicular relative to the surface;

an information processing system communicatively coupled to the air processing apparatus; and a sensor communicatively coupled to the information processing system, wherein the sensor is configured to obtain measurements concerning at least one of a noise level in a surrounding area of the air presentation apparatus and characteristics of the ambient air and processed air, and send signals to the information processing system to change the amount of air moved through the air processing apparatus based on the measurements.

2. A presentation apparatus as defined in claim 1, wherein a height of the exhaust structure is configured to extend to at least a top surface of the gaming machine.

3. A presentation apparatus as defined in claim 1, wherein the plenum is configured to complement the substantially predetermined position of the gaming machine.

4. A presentation apparatus as defined in claim 1, wherein the air processing apparatus is an air filtration apparatus.

5. A presentation apparatus, comprising:

a base;

a surface coupled to the base and configured to hold an object, wherein the base and the surface are configured to cooperate functionally with a function of the object;

a portion of an air processing apparatus disposed within the base and configured to move ambient air through the base to generate processed air;

an exhaust structure operatively coupled to the base and configured to enable the processed air to exit the presentation apparatus via a flow path that is spatially associated with a substantially predetermined position of the object;

an information processing system communicatively coupled to the air processing apparatus; and a sensor communicatively coupled to the information processing system, wherein the sensor is configured to obtain measurements concerning at least one of a noise level in a surrounding area of the presentation apparatus and characteristics of the ambient air and processed air, and send signals to the information processing system to change the amount of air moved through the air processing apparatus based on the measurements.

6. A presentation apparatus as defined in claim 5, wherein the exhaust structure comprises a plenum configured to complement the substantially predetermined position of the object.

7. A presentation apparatus as defined in claim 6, wherein the plenum is disposed between the exhaust structure and the base and includes an outer plenum surface that intersects a plane that is parallel to the surface.

8. A presentation apparatus as defined in claim 5, wherein the base and the surface are configured to facilitate use of the object by a person.

9. A presentation apparatus as defined in claim 5, wherein the air processing apparatus is an air filtration apparatus.

10. A presentation apparatus as defined in claim 5, wherein the information processing system is configured to be communicatively coupled to another information processing system.

11. A presentation apparatus as defined in claim 5, wherein the object is at least one of a gaming machine and an information display.

12. A presentation apparatus as defined in claim 5, further comprising at least one rotatable mechanism coupled to the base and configured to facilitate movement of the presentation apparatus from a first location to a second location.

13. A presentation apparatus as defined in claim 5, further comprising an intake structure operatively coupled to the base.

14. A presentation apparatus, comprising:

a cabinet having a surface configured to receive an object, wherein the cabinet includes at least a portion of an air processing apparatus configured to draw ambient air into the cabinet and to exhaust processed air from the presentation apparatus, wherein the surface, the base, and the air processing apparatus are configured to cooperate functionally with a function of the object;

an information processing system communicatively coupled to the air processing apparatus; and a sensor communicatively coupled to the information processing system, wherein the sensor is configured to obtain measurements concerning at least one of a noise level in a surrounding area of the presentation apparatus and characteristics of the ambient air and processed air, and send signals to the information processing system to change the amount of air moved through the air processing apparatus based on the measurements.

15. A presentation apparatus as defined in claim 14, further comprising an exhaust plenum operatively coupled to the cabinet and configured to enable the processed air to be exhausted from the presentation apparatus via a flow path that is spatially associated with a substantially predetermined position of the object.

16. A presentation apparatus as defined in claim 15, wherein the flow path is adjacent to the substantially predetermined position of the object.

17. A presentation apparatus as defined in claim 15, wherein the exhaust plenum is substantially perpendicular to the surface.

18. A presentation apparatus as defined in claim 14, wherein the object is configured to be used by a person.

19. A presentation apparatus as defined in claim 14, wherein the object is a gaming device.

20. A presentation apparatus as defined in claim 14, wherein the function of the object includes providing information to a person.

21. A presentation apparatus as defined in claim 14, wherein the air processing apparatus includes an air filter apparatus.

22. A presentation apparatus as defined in claim 14, wherein the surface is configured to provide access to the air processing apparatus.

23. A presentation apparatus as defined in claim 14, wherein the information processing system is configured to be communicatively coupled to another information processing system.

24. A presentation apparatus, comprising:

a cabinet having a base portion including at least a portion of an air filtration apparatus, wherein the air filtration apparatus includes a filter element and a fan configured to draw ambient air into the cabinet and to cause the ambient air to flow through the filter element to generate filtered air;

a surface coupled to the base portion, wherein the surface is configured to hold an object to be interacted with by a person; and an exhaust plenum operatively coupled to the base portion, wherein the exhaust plenum is configured to guide the flow of the filtered air through a flow path, and wherein the surface and the flow path are adapted to facilitate the interaction between the person and the object;

an information processing system communicatively coupled to the air filtration apparatus; and a sensor communicatively coupled to the information processing system, wherein the sensor is configured to obtain measurements concerning at least one of a noise level in a surrounding area of the presentation apparatus and characteristics of the ambient air and processed air, and send signals to the information processing system to change the amount of ambient air moved through the air filtration apparatus based on the measurements.

25. A presentation apparatus as defined in claim 24, wherein the exhaust plenum is substantially perpendicular to the surface.

26. A presentation apparatus as defined in claim 24, wherein the object is a gaming machine.

27. A presentation apparatus as defined in claim 24, wherein the filtered air is guided along the flow path in a direction that is substantially away from the object.

28. A presentation apparatus as defined in claim 24, wherein the information processing system is configured to determine a condition of the filter element.

29. A presentation apparatus as defined in claim 24, wherein the information processing system is configured to control an operational state of the air filtration apparatus based on a reading from the sensor of at least one of a noise level and a characteristic of the ambient air.

30. A presentation apparatus as defined in claim 24, further comprising at least one rotatable mechanism coupled to the base portion to facilitate movement of the presentation apparatus from a first location to a second location.

31. A presentation apparatus as defined in claim 24, wherein the surface is configured to provide access to the filter element.

32. A presentation apparatus, comprising:

a mounting surface configured to hold a removable object;

a base coupled to the mounting surface and comprising a filtration apparatus configured to filter ambient air; and an exhaust structure operatively coupled to the base and configured to structurally complement at least one of a shape and a location of the mounting surface and to guide filtered air out of the base via a flow path about a substantially predetermined location of the removable object; an information processing system communicatively coupled to the filtration apparatus; and a sensor communicatively coupled to the information processing system, wherein the sensor is configured to obtain measurements concerning at least one of a noise level in a surrounding area of the presentation apparatus and characteristics of the ambient air and processed air, and send signals to the information processing system to change the amount of ambient air moved through the filtration apparatus based on the measurements.

33. A presentation apparatus as defined in claim 32, wherein the exhaust structure is substantially perpendicular to the mounting surface.

34. A presentation apparatus as defined in claim 32, wherein the removable object is at least one of a gaming machine and an information display.

35. A presentation apparatus as defined in claim 32, wherein an outer surface of the exhaust structure is configured to hold an information display.

36. A presentation apparatus as defined in claim 32, wherein the information processing system is configured to be communicatively coupled to another information processing system.

37. A presentation apparatus as defined in claim 32, wherein the flow path is adjacent to the removable object and is configured to enable air to be moved in a direction that is substantially away from the removable object.

38. A system for processing air in a large room, with localized air processing control and minimal monopolization of floor space of the large room, the system comprising:

a plurality of presentation apparatuses networked together, wherein each apparatus includes:

a base;

a surface coupled to the base and configured to hold an object, wherein the base and the surface are configured to cooperate functionally with a function of the object;

a portion of an air processing apparatus disposed within the base and configured to move ambient air through the base to generate processed air, wherein the surface is located generally above the air processing apparatus;

an exhaust structure operatively coupled to the base and configured to enable the processed air to exit the presentation apparatus via a flow path that is spatially associated with a substantially predetermined position of the object;

an information processing system communicatively coupled to the air processing apparatus for controlling the presentation apparatus; and a central processing system, wherein the information processing systems of the plurality of presentation apparatuses are configured to communicate with the central processing system.

39. The system of claim 38 which further comprises a sensor communicatively coupled to the information processing system, wherein the sensor is configured to obtain measurements concerning characteristics of at least one of a noise level in a surrounding area of the presentation apparatus, the ambient air and processed air and send signals to the information processing system to change the amount of air moved through the air processing apparatus based on the measurements.

40. The system of claim 38 wherein the object each surface is configured to hold is a gaming machine, and the base and the surface are configured to facilitate use of the gaming machine by a person.

41. The system of claim 38 wherein the exhaust structure comprises a plenum configured to complement the substantially predetermined position of the object, and wherein the plenum is disposed between the exhaust structure and the base and includes an outer plenum surface that intersects a plane that is parallel to the surface.

* * * * *